US005570927A

United States Patent [19]

LaPointe et al.

[11] Patent Number: 5,570,927

[45] Date of Patent: Nov. 5, 1996

[54] MODULAR WALL PROXIMITY RECLINING CHAIR

[75] Inventors: Larry P. LaPointe, Temperance; Jonathan R. Saul, Erie; Karl J. Komorowski, Petersburg, all of Mich.

[73] Assignee: La-Z-Boy Chair Company, Monroe, Mich.

[21] Appl. No.: 429,105

[22] Filed: Apr. 26, 1995

Related U.S. Application Data

[63] Continuation-in-part of Ser. No. 321,079, Oct. 14, 1994, abandoned, which is a continuation-in-part of Ser. No. 230,541, Apr. 20, 1994, Pat. No. 5,427,431, which is a division of Ser. No. 897,546, Jun. 18, 1992, Pat. No. 5,323,526, which is a continuation-in-part of Ser. No. 819,784, Jan. 13, 1992, Pat. No. 5,222,286, which is a continuation-in-part of Ser. No. 772,231, Oct. 11, 1991, Pat. No. 5,301,413.

[51] Int. Cl.[6] ..... A47C 1/02

[52] U.S. Cl. ..... 297/85; 297/318

[58] Field of Search ..... 297/83–85, 68–71, 297/87, 89, 325, 329, 318, 423.19, 423.26

[56] References Cited

U.S. PATENT DOCUMENTS

| | | |
|---|---|---|
| 1,048,306 | 12/1912 | Greilick . |
| 2,677,412 | 5/1954 | Thomas . |
| 2,918,110 | 12/1959 | Schielphacke . |
| 2,918,111 | 12/1959 | Schielphacke . |
| 2,919,745 | 1/1960 | Schielphacke . |
| 3,096,121 | 1/1960 | Knabusch et al. . |
| 3,567,280 | 3/1971 | Bradshaw . |
| 3,858,932 | 1/1975 | Crum et al. . |
| 3,904,240 | 9/1975 | Rogers, Jr. et al. . |
| 4,071,275 | 1/1978 | Rogers, Jr. . |
| 4,226,469 | 10/1980 | Rogers, Jr. et al. . |
| 4,291,913 | 9/1981 | Kowalski . |
| 4,364,603 | 12/1982 | Johnson . |
| 4,367,895 | 1/1983 | Pacitti et al. . |
| 4,740,031 | 4/1988 | Rogers, Jr. . |
| 5,011,220 | 4/1991 | LaPointe . |
| 5,141,284 | 8/1992 | LaPointe ..... 297/85 |
| 5,147,108 | 9/1992 | LaPointe . |
| 5,217,276 | 6/1993 | LaPointe et al. . |
| 5,271,660 | 12/1993 | LaPointe et al. . |
| 5,292,170 | 3/1994 | LaPointe et al. . |

FOREIGN PATENT DOCUMENTS

| | | |
|---|---|---|
| 73511 | 1/1986 | Taiwan . |

*Primary Examiner*—Milton Nelson, Jr.
*Attorney, Agent, or Firm*—Harness, Dickey & Pierce, P.L.C.

[57] ABSTRACT

A modular wall proximity reclining/tilt chair is disclosed. The modular wall proximity reclining/tilt chair includes a simplified actuation mechanism which significantly reduces system complexity and weight while providing improved comfort to the seat occupant. The construction is such that the pre-assembled actuation mechanism is integrally suspended from and interdependent with box-like modular frame components. In this manner, the frame components can be upholstered prior to final assembly with the actuation mechanism.

35 Claims, 13 Drawing Sheets

FIG 4
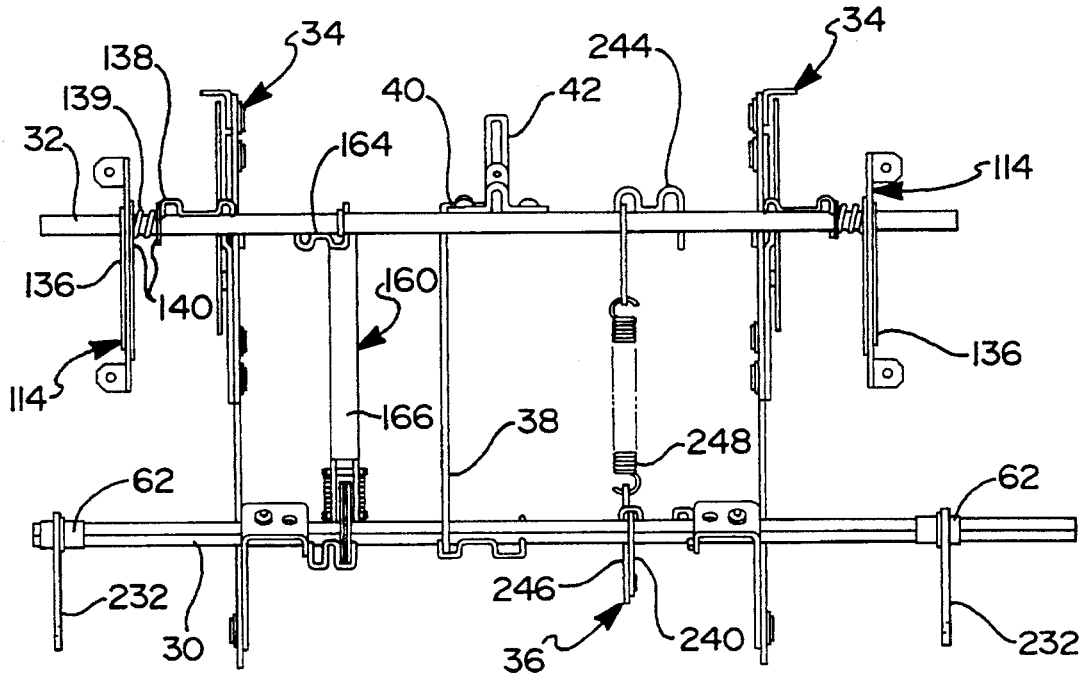
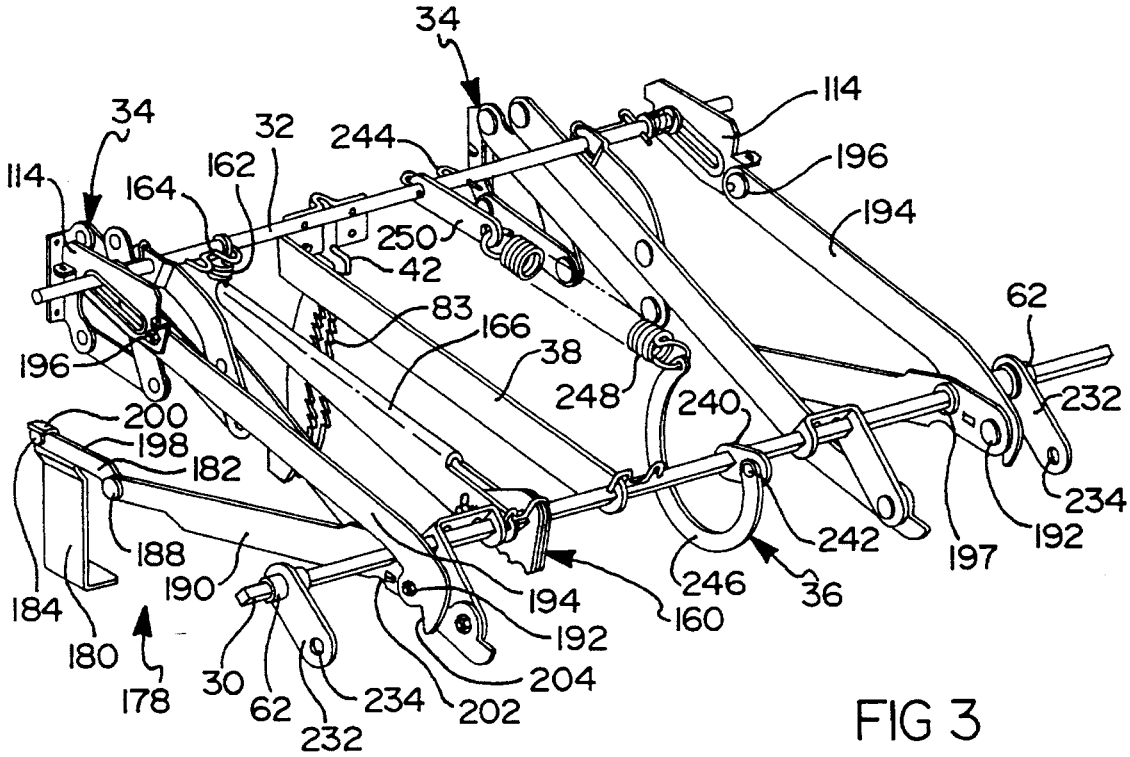
FIG 3

FIG 10F
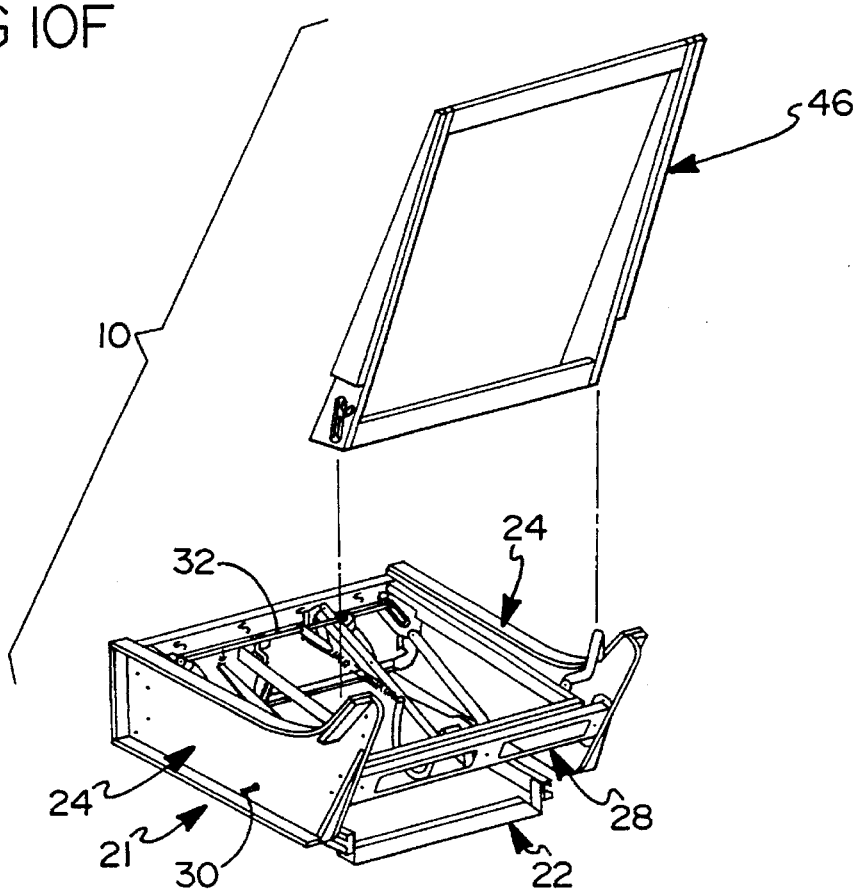
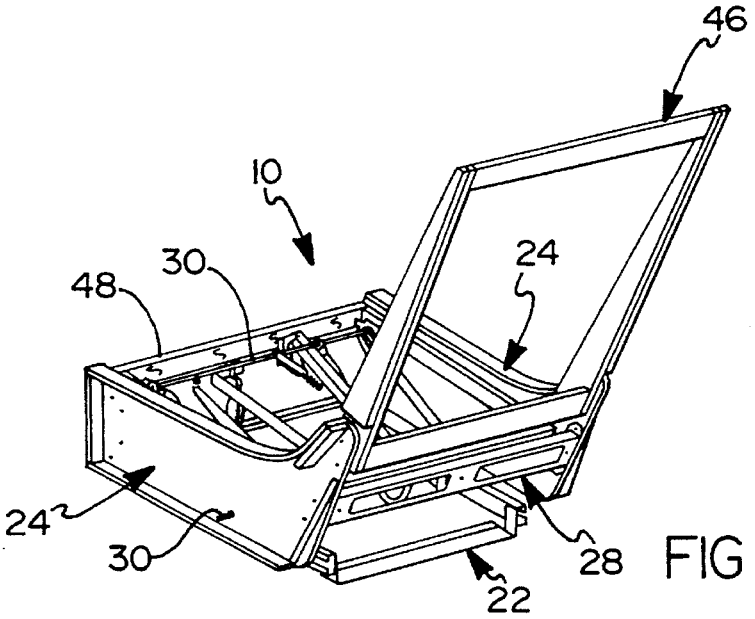
FIG 10G

MODULAR WALL PROXIMITY RECLINING CHAIR

CROSS-REFERENCE TO RELATED APPLICATION

This is a continuation-in-part of U.S. patent application Ser. No. 08/321,079, filed on Oct. 14, 1994 and entitled "Modular Wall Proximity Reclining Chair", (now abandoned) which is a continuation-in-part of U.S. patent application Ser. No. 08/230,541, filed on Apr. 20, 1994 and entitled "Method For Assembling A Modular Wall Proximity Reclining Chair", (now U.S. Pat. No. 5,427,431 which is a divisional of U.S. patent application Ser. No. 07/897,546, filed Jun. 18, 1992 and entitled "Method For Assembling A Modular Wall Proximity Reclining Chair" (now U.S. Pat. No. 5,323,526), which is a continuation-in-part of U.S. patent application Ser. No. 07/819,784, filed on Jan. 13, 1992 and entitled "Modular Reclining/Tilt Chair And Method" (now U.S. Pat. No. 5,222,286), which is a continuation-in-part of U.S. Ser. No. 07/772,231, filed on Oct. 11, 1991 and entitled "Modular Reclining Chair And Method" (now U.S. Pat. No. 5,301,413), all assigned to the common assignee of the present invention.

BACKGROUND OF THE INVENTION

The present invention relates generally to reclining chairs and, more particularly, to an improved "wall proximity" reclining chair.

Traditionally, reclining chairs are equipped with an actuation mechanism which is operatively interconnected between a prefabricated chair frame and a stationary base assembly. The actuation mechanism is typically a combination of various mechanical linkages operable for providing various comfort features such as independent reclining movement of a seat assembly as well as actuation of an extensible leg rest assembly and associated tilting of the chair frame. In "wall proximity" reclining chairs, the actuation mechanism must also be operable to maintain a generally constant clearance between the reclinable seat assembly and an adjacent stationary structure (i.e., wall surface, table, etc.) during the entire range of reclining movement. Generally, the actuation mechanism includes a track arrangement for causing longitudinal movement of the entire chair frame relative to the stationary base assembly during "wall proximity" reclining movement to accommodate for rearward angular movement of the seat back relative to the chair frame.

Due to the relative complexity of conventional actuation mechanisms, it is common practice in the furniture industry to assemble the various mechanical linkages into a "standalone" mechanism frame assembly. A prefabricated U-shaped chair frame is frequently bolted around the mechanism frame with the open portion of the "U" corresponding to the front of the chair. Accordingly, such reclining chairs having a mechanism frame assembly located within a prefabricated chair frame are commonly referred to as having a "frame within a frame" construction. As such, most furniture manufacturers do not upholster the exterior surfaces of the prefabricated chair frame until after the mechanism frame assembly has been installed. Unfortunately, the upholstering operation is very inefficient and expensive in that the frequently heavy and cumbersome prefabricated chair frame must be manually manipulated in an extremely labor-intensive manner.

Another disadvantage associated with reclining chairs equipped with conventional actuation mechanisms is that a relatively large amount of frictional drag is typically generated between the upholstered components which must be overcome for smooth movement of the seat assembly between the "upright" and "reclined" positions. As such, lighter weight seat occupants must normally exert a deliberate leveraged thrust or force, in addition to pulling the actuator lever, for completely extending a leg rest assembly and/or moving the seat assembly to its "reclined" position. Moreover, it is often difficult for the seat occupant to return the seat assembly to the "upright" position from the fully "reclined" position due to the relatively large included angle between the seat member and the reclined seat back. Therefore, the seat occupant must exert a relatively large and deliberate leveraged force to return the reclined seat assembly to its full "upright" position. Furthermore, in many conventional recliners, the leg rest assembly cannot be retracted to its "stowed" position from an extended or elevated position until after the seat occupant has completely returned the seat assembly to its fully "upright" position. Likewise, some reclining chairs do not permit independent actuation of the leg rest assembly during the entire range of reclining motion.

While many conventional reclining chairs operate satisfactorily, furniture manufacturers are continually striving to develop improved frames and actuation mechanisms for reducing system complexity and increasing structural soundness and smoothness of operation as well as occupant comfort. Such advanced development is particularly important for "wall proximity" reclining chairs since their actuation mechanisms are inherently more complex due to the requirement of accommodating rearward reclining movement of the seat back relative to a stationary structure. Furthermore, there is a continuing desire to develop improved fabrication and assembly techniques which will result in reduced costs while promoting increased efficiency and improved product quality.

SUMMARY OF THE INVENTION

In accordance with the principles of the present invention, an improved actuation mechanism is disclosed which is adapted to permit selective and independent reclining movement of a seat back relative to a seat member as well as actuation (i.e. extending and retracting) of a leg rest assembly and simultaneous tilting of the chair frame relative to a stationary base. In addition, the improved actuation mechanism is also adapted to provide means for causing translational movement of the chair frame during reclining movement of the seat assembly to maintain a generally constant clearance between the seat back and an adjacent stationary structure, such action being referred to as "wall proximity" reclining movement. As such, the improved actuation mechanism of the present invention is integrated into a wall proximity reclining/tilt chair wherein the minimal force, achieved upon shifting the weight of the seat occupant, is utilized as the primary means for moving the seat assembly between an "upright" position and a wall proximity "reclined" position.

As a related object, an improved construction for wall proximity reclining-type seating units (i.e., chairs, sofas, loveseats and the like) is disclosed which can be simply, efficiently, and rigidly assembled so as to significantly reduce its overall complexity, weight, and cost while providing improved operation and comfort to the seat occupant.

It is another object of the present invention to reduce the input force exerted by the seat occupant for smoother operation of the actuation mechanism. As a further related object, the complexity of improved actuation mechanism has been significantly simplified to incorporate mechanical linkage and drive components optimally designed for substantially reducing frictional losses so as to promote easier and smoother actuation. Moreover, the various operative linkages are designed to permit "pre-assembly" of the actuation mechanism without utilization of a conventional mechanism frame assembly.

A further object of the present invention is to provide a simplified "knock-down" frame construction which is structurally rigid, easy to assemble, and reduces lateral or "side-to-side" deflection of the chair arms. Accordingly, the integrated or "knock-down" construction of the reclining chair facilitates application of unique fabrication and assembly techniques which effectively result in increased production efficiency and cost savings while concomitantly producing a high-quality article of furniture. In general, the construction of the improved wall proximity reclining chair is such that the pre-assembled actuation mechanism cannot be divorced from the pre-upholstered frame components which, when assembled, are rigidly interconnected to define a "box-like" chair frame from which the pre-assembled actuation mechanism is integrally suspended. In this manner, the conventional construction of supporting the actuation mechanism within a separate and distinct mechanism frame assembly is no longer required. The pre-assembled actuation mechanism includes a drive rod and a front support shaft which are each directly supported between left and right upholstered side frame assemblies. As such, extremely precise alignment of the actuation mechanism with respect to each of the separate pre-upholstered frame components is possible. Moreover, front and rear cross-rail means interconnect the left and right side frame assemblies to define a "unitized" and extremely rigid box-like chair frame or body for inhibiting side-to-side flexion of the actuation mechanism suspended therein as well as of the side frame assemblies themselves. In addition to the structural and functional advantages associated with the modular wall proximity reclining chair of the present invention, a unique method of assembling the pre-assembled actuation mechanism as an integrated component within the pre-upholstered frame components is disclosed.

Yet another object of the present invention is to provide an improved means for securing the bearing link assembly to a chair frame having reduced thickness side panels. The improved means for securing eliminates the need to use cross doweling in the side panels and improves the structural integrity of the interface between the chair frame and bearing link assembly.

In accordance with a preferred embodiment, the wall proximity reclining chair of the present invention includes a "three-way" actuation mechanism which can be actuated to independently "recline" in wall proximity fashion a seat back relative to a seat member or move a leg rest assembly between "retracted" and "extended" positions. In addition, tilt linkage means are provided to cause substantially concurrent "tilting" movement of the entire chair frame from a "non-tilted" to a "tilted" position upon movement of the leg rest assembly from the "retracted" position to the "extended" position, respectively. Moreover, a full range of independent "wall proximity" reclining movement of the seat back relative to the seat member is possible regardless of the operative position of the leg rest assembly between its fully "retracted" and "extended" positions. This "wall proximity" reclining movement also produces substantially concurrent horizontal translational and "tilting" movement of the chair frame. Therefore, tilting of the chair frame due to reclining movement of the seat back and tilting due to movement of the leg rest assembly are automatic, independent and cumulative in nature. Moreover, the translational movement of the chair frame is effective in maintaining a substantially constant clearance or "proximity" between the seat back and an adjacent stationary structure during the wall proximity reclining movement.

Additional objects, advantages, and features of the present invention will become apparent from the following description and appended claims, taken in conjunction with the accompanying drawings.

DESCRIPTION OF THE DRAWINGS

FIG. 3 is an enlarged perspective view of the improved actuation mechanism shown in FIG. 2;

FIG. 4 is an enlarged view of the improved actuation mechanism shown in FIG. 3.

FIGS. 10A through 10G are various perspective views provided to illustrate a preferred method for assembling the wall proximity reclining/tilt chair of FIGS. 1 and 2.

DETAILED DESCRIPTION OF THE INVENTION

In accordance with the teachings of the present invention, an improved actuation mechanism for use in single and multi-person articles of furniture (i.e. chairs and sofas or loveseats) is disclosed. In addition, the present invention is also directed to a method of assembling the improved actuation mechanism as a pre-assembled and "integrated" component of a wall proximity reclining-type chair or the like. More particularly, the method of assembly disclosed in commonly owned U.S. Pat. No. 5,323,506 is clearly applicable for use with the present invention. As will be described, the pre-assembled actuation mechanism is uniquely suspended in a "fixed" three-pivot-point arrangement from pre-upholstered box-like frame components so as to provide precise mechanical alignment and superior structural rigidity while concomitantly facilitating application of highly efficient fabrication and assembly processes.

In the particular embodiment disclosed, the article of furniture shown is a combination wall proximity recliner and tilt chair, hereinafter referred to wall proximity reclining/tilt chair 10, which includes a pre-assembled actuation mechanism 12 and various upholstered frame components that can be quickly and simply assembled as a modular seating unit. Such "modular" construction provides a significant advancement over conventional furniture fabrication and assembly techniques since manipulation of heavy and cumbersome "unitized" chair frames during upholstery installation is no longer required. As such, each frame component or frame sub-assembly can be upholstered prior to modular assembly with actuation mechanism 12 so as to improve individual component quality as well as overall system quality and production efficiency. Moreover, since actuation mechanism 12 of the present invention is relatively compact in size, the use of loose upholstered cushions, which is an important feature in marketing various styles of chair, sofa or loveseat furniture, is also possible. It should also be understood, however, that the improvements now incorporated into actuation mechanism 12 are not limited to use with reclining/tilting chair 10, but rather are clearly applicable for use in virtually any type of single or multi-person article of furniture. As such, the particular structure of the various sub-assemblies and components which, when assembled, define reclining/tilting chair 10 is merely intended to illustrate but one furniture application to which the present invention is applicable.

Figure 1:
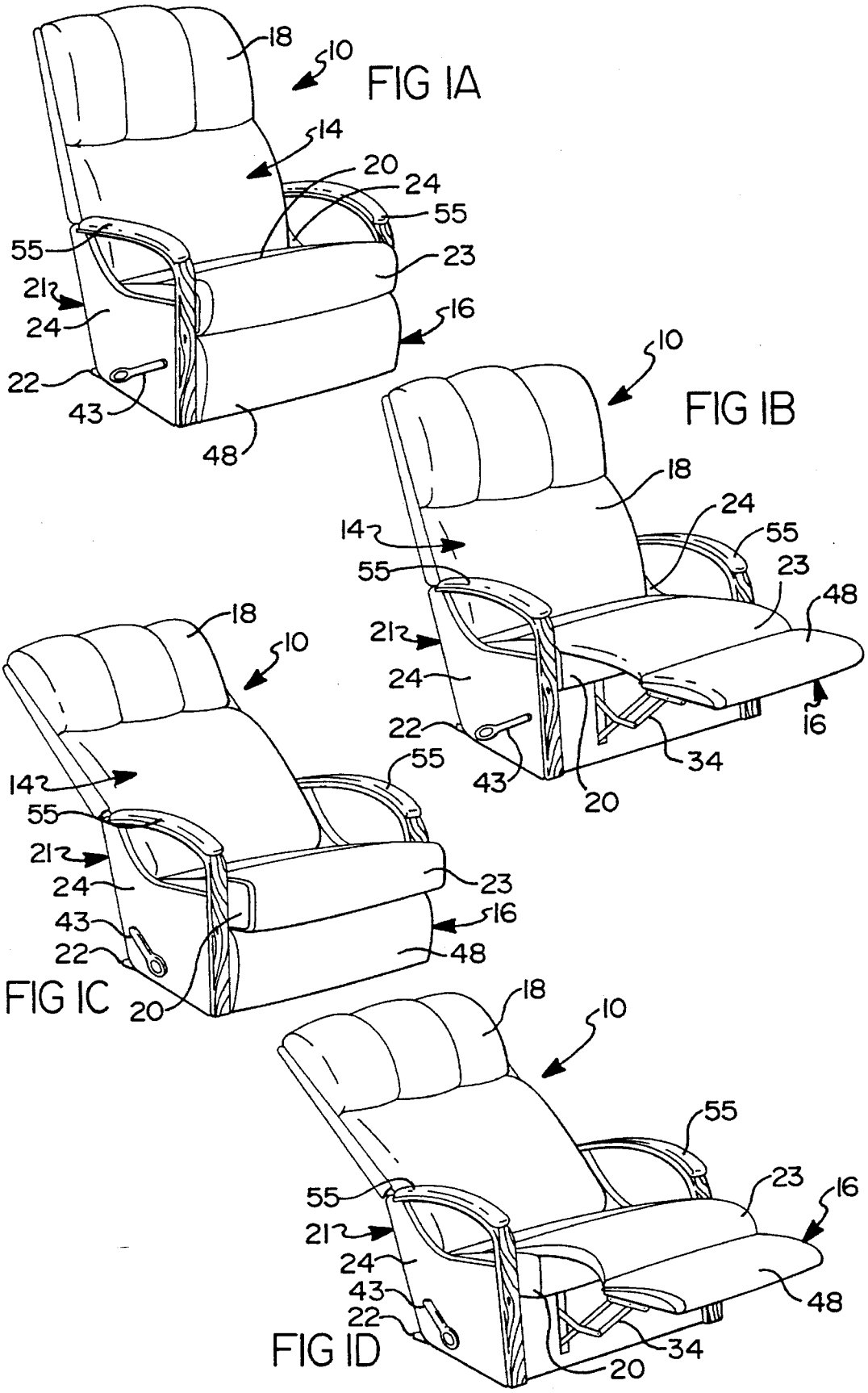
FIGS. 1A through 1D are perspective views of an exemplary wall proximity reclining/tilt chair shown in various operative positions, the "modular" components of which have been fabricated and assembled in accordance with the principles of the present invention.

With particular reference to the drawings, the functional and structural aspects of actuation mechanism 12, as operably suspended from the various pre-upholstered box-like frame components of reclining/tilt chair 10, will now be described. More particularly, FIG. 1A depicts an exemplary wall proximity reclining/tilt chair 10 having its seat assembly 14 shown in a fully "upright/non-tilted" position with leg rest assembly 16 retracted to its "stowed" position for permitting a seat occupant to enjoy conventional seating. Seat assembly 14 is shown to include a seatback 18 that is interconnected to a seat member 20 for reclining movement via a suitable seat swing mechanism. FIG. 1B illustrates reclining/tilt chair 10 in the "upright/tilted" position with leg rest assembly 16 being protracted to its "extended" position. In this position, chair frame 21 is slightly rearwardly tilted with respect to base assembly 22. As is also apparent, reclining/tilt chair 10 incorporates a "chaise lounge" feature wherein an upholstered "pad-over" bridge 23 is interconnected between the front edge of seat member 20 and the rear edge of leg rest assembly 16 to provide a continuous upholstered surface therebetween.

As seen in FIG. 1C, seat back 18 is shown in a wall proximity "reclined" position relative to seat member 20 with leg rest assembly 16 positioned in its retracted or "stowed" position. As is known, reclining movement of seat assembly 14 is accomplished by the seat occupant deliberately applying pressure to seat back 18 such that the seat swing mechanism causes seat member 20 to move forwardly and upwardly for maintaining seating comfort while the included angle increases therebetween. In addition, the entire chair frame 21 is also supported for translational movement with respect to stationary base assembly 22. Therefore, upon movement of seat assembly 14 to the "reclined" position, chair frame 21 moves forwardly for maintaining a relative constant clearance (i.e., wall proximity) between seat back 18 and an adjacent wall surface. Furthermore, chair frame 21 is rearwardly "tilted" upon such forward translational movement of chair frame 21 on base assembly 22. Moreover, the tilting movement of chair frame 21 due to reclining movement of seat assembly 14 is independent of, and cumulative with, the tilting movement caused upon movement of leg rest assembly 16 from its "stowed" position to its "extended" position. Thereafter, chair 10 may be easily returned to the "upright/non-tilted" position of FIG. 1A upon deliberate application of rearward pressure to seat assembly 14 or, more simply, if the seat occupant leans forward to remove pressure from seat back 18. Finally, FIG. 1D shows seat assembly 14 of chair 10 in the wall proximity "reclined/tilted" position with leg rest assembly 16 protracted to the "extended" position. In this position, chair frame 21 is rearwardly tilted to its maximum extent relative to base assembly 22 and a maximum reclination angle is established between seat back 18 and seat member 20.

For purposes of clarity, the term "tilting" refers to angular movement of chair frame 21 and, in turn, seat assembly 14 about a horizontal axis relative to base assembly 22. Such "tilting" movement occurs substantially concurrently with protraction of leg rest assembly 16 via selective rotation of a suitable actuator by the seat occupant and/or upon reclining movement of seat assembly 14. Wall proximity "reclining" refers generally to the concurrent angular movement of seat assembly 14 relative to chair frame 21 and the translational movement of chair frame 21 relative to base 22 for maintaining a relatively constant clearance between the seat back 18 and the adjacent structure or wall surface. Moreover, the present invention is designed to permit the seat occupant to select and maintain virtually any desired reclined position within the entire range of reclining movement between the "upright" and fully "reclined" positions.

Figure 2:
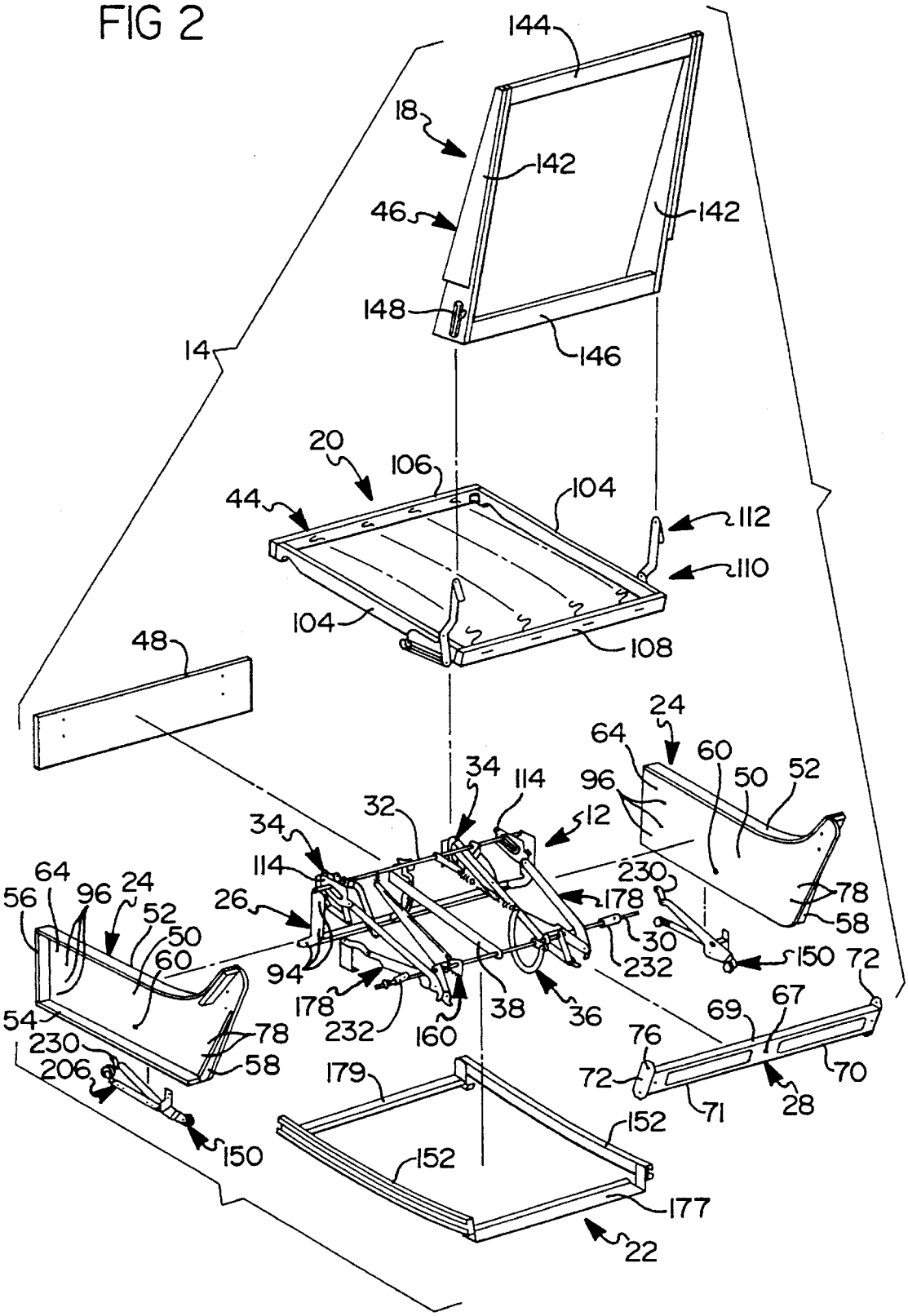
FIG. 2 is an exploded perspective view of the wall proximity reclining/tilt chair shown in FIG. 1 with its upholstery, springs and other parts removed from the pre-assembled components for illustrating their integrated and interdependent association with an improved actuation mechanism.

In accordance with the primary design features of the present invention, the various pre-assembled and upholstered frame components provided for operably suspending actuation mechanism 12 within reclining/tilt chair 10 will now be clearly described. For purposes of clarity, FIG. 2 shows the various pre-assembled frame components with their upholstery, padding, springs, etc. removed to better illustrate the interdependency of the frame components construction which can be rapidly and rigidly assembled in a relative easy and efficient manner. As such, all of the frame components can be individually fabricated or sub-assembled to include the requisite brackets, springs, padding and upholstery on an "off-line" batch-type basis. Thereafter, the various pre-assembled and upholstered frame components are assembled for totally integrating actuation mechanism 12 therein. As noted, while the disclosure is primarily directed hereinafter to wall proximity reclining/tilt chair 10, it will be appreciated that the novel modular construction and method of assembly taught by the present invention can be readily incorporated into wall proximity sofas, loveseats and the like.

As seen from FIGS. 2 through 6, actuation mechanism 12 of wall proximity reclining/tilt chair 10 is integrated into and operably suspended from chair frame 21 and, in particular, from left and right side frame assemblies 24. In addition to side frame assemblies 24, chair 10 also includes a front rail assembly 26 and a rear rail 28 which, when interconnected, define a rigid "box-like" chair frame. Preferably, most of the structural frame components such as side frame assemblies 24, front rail assembly 26, rear rail 28, seat frame 44, seat back frame 46 and leg rest frame board 48 are each constructed in a manner which enables them to support springs, padding, upholstery, etc. in order to complete a decorative and stylish reclining/tilt chair 10 similar to that shown in FIGS. 1A through 1D. More preferably, each of these frame components, except for front rail assembly 26 and rear rail 28, are fabricated from one or more wood panels and/or rails that are fixedly secured together by suitable fasteners, such as dowels, staples, nails and screws, and which may be reinforced at critical joints by metal reinforcement plates or brackets and/or wood corner blocks in a known manner. As will also be detailed, front rail assembly 26 is assembled from a plurality of components while rear rail 28 is a unitary component, with some or all of such components preferably being fabricated as stamped metal panels. As previously noted, each frame component is individually pre-assembled for subsequent modular assembly into wall proximity reclining/tilt chair 10. However, it is to be understood that the specific construction shown for each frame component is merely exemplary in nature.

With continued reference to FIGS. 2 through 6, actuation mechanism 12 is shown to include a drive rod 30 and front support shaft 32, both of which are spatially oriented to be precisely located and "suspended" from left and right side frame assemblies 24. In the preferred construction, drive rod 30 is an elongated square shaft having a manually-operable handle 43 (FIG. 1) secured thereto adjacent an upholstered exterior portion of one of side frame assemblies 24 and which can be easily reached by a person seated in chair 10 for convenient actuation thereof. In addition, leg rest assembly 16 is supported for extensible movement on actuation mechanism 12. More specifically, leg rest assembly 16 includes left and right pantograph linkage mechanisms 34 and a spring-assisted toggle mechanism 36 which are operably associated with drive rod 30 and front support shaft 32 for permitting the seat occupant to selectively actuate leg rest assembly 16 in response to rotation of drive rod 30 via handle 43. A rigid cross-brace 38 is located between side frame assemblies 24 and is secured between drive rod 30 and support shaft 32 for providing structural rigidity within actuation mechanism 12. Preferably, one end of cross-brace 38 is journally supported on drive rod 30 while the opposite end thereof is configured as a bracket 40 which is fixedly secured, such as by a suitable threaded fastener, to a central segment 42 of front rail assembly 26. Furthermore, central segment 42 of front rail assembly 26 is fixedly secured, via threaded fasteners, to support shaft 32. Thus, support shaft 32 is fixed to front rail assembly 26 to inhibit rotation of support shaft 32 upon rotation of drive rod 30.

Left and right side frame assemblies 24 are each constructed as rigid, roughly rectangular frame components having a universal side panel 50 and horizontal bottom and top members 52 and 54, respectively. Decorative chair arms 55 are fixed to top members 52. In addition, each side frame assembly 24 also includes a front post 56 which preferably has at least a lower portion substantially perpendicular to the floor, and an inclined rear post member 58 such that front and rear posts 56 and 58, respectively, and top and bottom horizontal members 54 and 52, respectively, are each rigidly secured to a side panel 50. Moreover, side panels 50 have a first set of alignable bores 60 formed therein that are sized to receive opposite ends of drive rod 30. In addition, sleeve journals 62 are sized for retention within bores 60 to permit rotation of drive rod 30 therein. As such, alignable bores 60 define a first set of "fixed" pivot or suspension points that are seated directly within side panels 50. In this manner, drive rod 30 has a fixed pivot arrangement and not a conventional "floating" type which typically required additional linkages.

Side panels 50 also include a second set of alignable bores 64 oriented to receive opposite ends of support shaft 32 therein. As previously noted, front rail assembly 26 secures rigid cross-brace 38 to support shaft 32 for maintaining the desired orientation and "side-to-side" positioning of support shaft 32. As such, aligned bores 64 are seated directly in side panels 50 to define a second set of "fixed" pivot or suspension points. Since the first and second sets of aligned bores 60 and 64, respectively, are oriented in a predetermined arrangement on side panels 50, it is apparent that all critical hole locations for left and right side panels 50 may be drilled in a single operation. Therefore, pre-assembly of actuation mechanism 12 facilitates "final" assembly of chair 10 since drive rod 30 and support shaft 32 are oriented for receipt within aligned bores 60 and 64, respectively. Side panels 50 do not become "left" or "right" until the members 52, 54, 56, and 58 are affixed thereto. Thus, by fabricating side panels 50 as a universal component, the accuracy of locating aligned bores 60 and 64 is greatly enhanced.

With particular reference to the exploded perspective view of FIG. 2, means for rigidly securing front rail assembly 26 and rear rail 28 to side frame assemblies 24 for integrally suspending actuation mechanism 12 within a rigid "box-like" chair frame is disclosed. More particularly, rear rail 28 is a one-piece metal component, preferably a stamping, which includes a laterally extending cross-member 70 and left and right angled end brackets 72. Cross member 70 is generally U-shaped in cross-section so as to include a rear panel 67 and top and bottom panels 69 and 71, respectively, that are integral with and generally orthogonally oriented relative to rear panel 67. A pair of bores 76 are provided on each end bracket 72 that are alignable with corresponding sets of bores 78 formed in side panels 50 for properly locating rear rail 28 with respect to side frame assemblies 24. As will be appreciated, bores 78 may also be drilled simultaneously with bores 60 and 64 to further enhance pre-assembled quality. Thereafter, suitable fasteners, such as threaded screws, are used for fixedly securing angled end brackets 72 and, in turn, rear rail 28 directly to the inner surface of side panels 50. Typically, an upholstered rear "tailgate" (not shown) is affixed to rear cross-member 70 since cross-member 70 is not generally upholstered.

Figure 7:
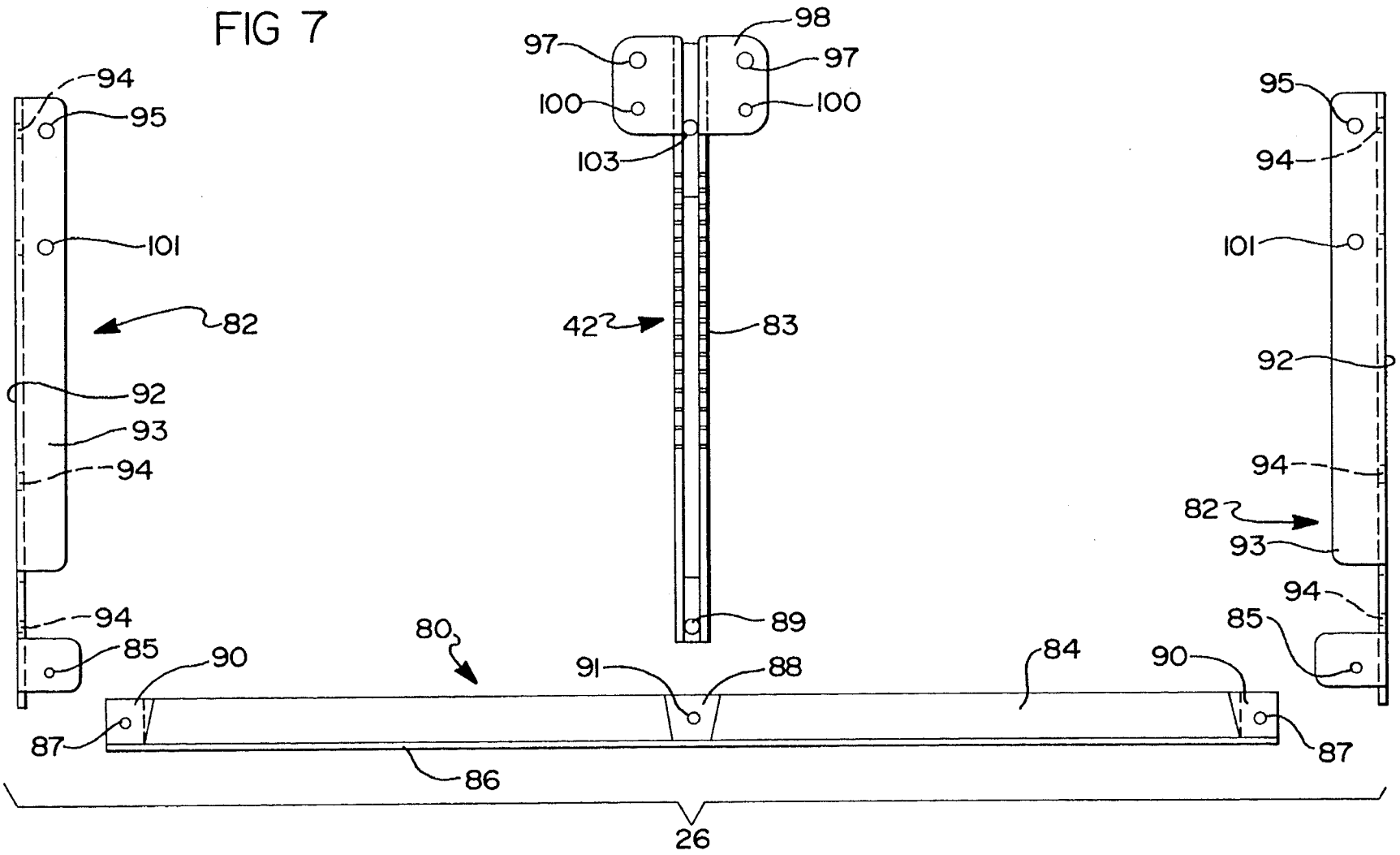
FIG. 7 is an exploded elevation view of the multi-piece front rail assembly shown in FIG. 2.

As can best be seen from FIG. 7, front rail assembly 26 is a multi-piece assembly including a lower cross-member segment 80 and a pair of end segments 82 that extend upwardly from opposite lateral ends of cross-member segment 80 and which are substantially parallel to, but laterally displaced therefrom. As noted, front rail assembly 26 also includes a central segment 42 which is secured to cross-member segment 80 substantially midway between end segments 82. In a presently preferred embodiment, central segment 42 is a universal component and, as such, has a toothed sector 83 formed thereon. While not of use with reclining/tilting chair 10, toothed sector 83 of center segment 42 is for use in conjunction with a pawl mechanism (not shown) on rocking chairs equipped with an extensible leg rest assembly. The pawl and ratchet assembly is operable for releasably retaining the chair frame in any one of a plurality of rearwardly "tilted" sequential positions upon the leg rest assembly being protracted to its fully extended position. One example of a pawl and ratchet assembly is disclosed in commonly owned U.S. Pat. No. 5,328,235 entitled "Pawl And Ratchet Assembly".

Lower cross-member segment 80 is generally L-shaped in cross-section and includes a vertical flange 84 and a horizontal flange 86. An embossed recess 88 is formed in the middle of lower cross-member segment 80 for receiving an end portion of central segment 42. In a similar manner, an embossed recess 90 is also formed at each end of lower cross-member segment 80 for receiving the lower end portion of end segments 82. This arrangement between recess 88 and central segment 42 as well as between recesses 90 and end segments 82 facilitates more precise alignment and assembly of front rail assembly 26. Preferably, the lower end of central segment 42 and end segments 82 are rigidly secured to lower cross-member segment 80 at their respective embossed portions by, for example, threaded fasteners. More particularly, bores 85 on end segments 82 are alignable with bores 87 formed in recesses 90 of lower cross-member segment 80 while bore 89 on central segment 42 is alignable with a bore 91 formed in recess 88 on lower cross-member segment 80 for receipt of suitable threaded fasteners. It should be understood, however, that any suitable means for fastening, such as by welding, riveting, or the like, may be used to secure the individual components of front rail assembly 26 together.

To secure front rail assembly 26 to side rail assemblies 24, each end member segments 82 is formed with an outer flange bracket 92 which extend transversely to its front face segment 93 and which includes a series of bores 94 that are alignable with a series of bores 96 formed in side frame assemblies 24. In addition, each flange bracket 92 also includes a guide slot (not shown) for retaining and locating the opposite end portions of support shaft 32 therein. As noted, front face 93 of each end segment 82 is generally parallel to but laterally displaced from the front face of lower cross-member segment 80 and includes a bore 95 which is aligned in a common horizontal plane with the guide slot. Bores 95 are provided for fixing end segments 82 of front frame rail assembly 26 to the opposite end portions of support shaft 32. Additionally, a pair of bores 97 are formed in a top bracket portion 98 of central segment 42 for fixing central segment 42 to a central portion of support shaft 32. Finally, bores 100 are provided for fixing bracket 40 of cross brace 38 onto either side of top bracket segment 98. Thus, central segment 42 cooperates with the laterally-spaced end segments 82 and support shaft 32 for defining a pair of enlarged apertures for permitting extension and retraction of leg rest assembly 16 therethrough.

In view of the above, support shaft 32 is preferably pre-drilled with four bores which are alignable with bores 95 and 97 formed in end segments 82 and central segment 42, respectively, for receiving threaded fasteners therein to rigidly secure support shaft 32 directly to front rail assembly 26. As such, support shaft 32 is a multifunctional mechanism member that is non-rotatably fixed to front rail assembly 26 and acts as an upper cross-member for providing superior rigidity to the front portion of chair 10. Support shaft 32 also supports leg rest pantograph linkages 34, front seat slides 114, a detent mechanism 160, and a spring connection link 250. As can be further appreciated, forming lower cross-member segment 80, end segments 82 and central segment 42 as separate components greatly reduces the complexity of the metal forming dies and simplifies the assembly operations such that overall cost is reduced while quality of reclining chair 10 is enhanced. An additional benefit of front rail assembly 26 is that the lower cross-member 80 may now be displaced laterally from end segments 82 and central segment 42 for providing additional clearance for leg rest assembly 16. Thus, the exterior surface of lower cross-member segment 80, in a completed front rail assembly 26, is displaced laterally from end segments 82 and central segment 42 while still maintaining a substantially parallel relationship thereto. Such a displaced mounting arrangement of lower cross-member segment 80 provides for maintaining the compact nature of the chair of the present invention as compared to conventional chairs while providing sufficient clearance between the chair frame and leg rest frame board 48 for accommodating such features as a "pop-up" ottoman frame board (not shown) if leg rest assembly 16 is so equipped. Finally, end segments 82 and central segment 42 are each formed with a plurality of apertures 101 and 103, respectively, for receiving push-in retainers 104 for mounting an upholstered front tailgate to front rail assembly 26.

Figure 5:
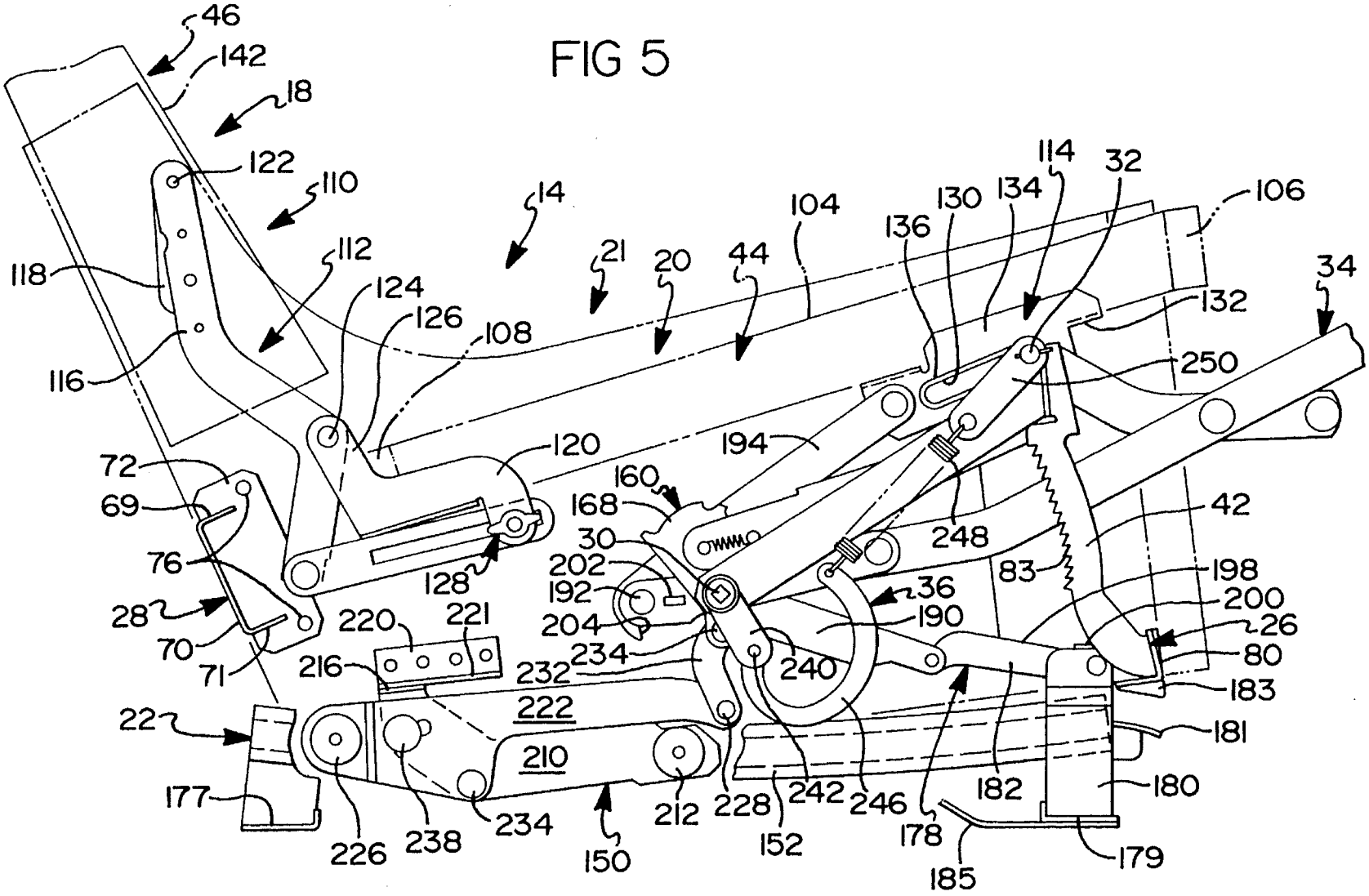
FIG. 5 is a sectional view illustrating the wall proximity reclining/tilt chair in a "leg rest extended/tilted" position.
Figure 6:
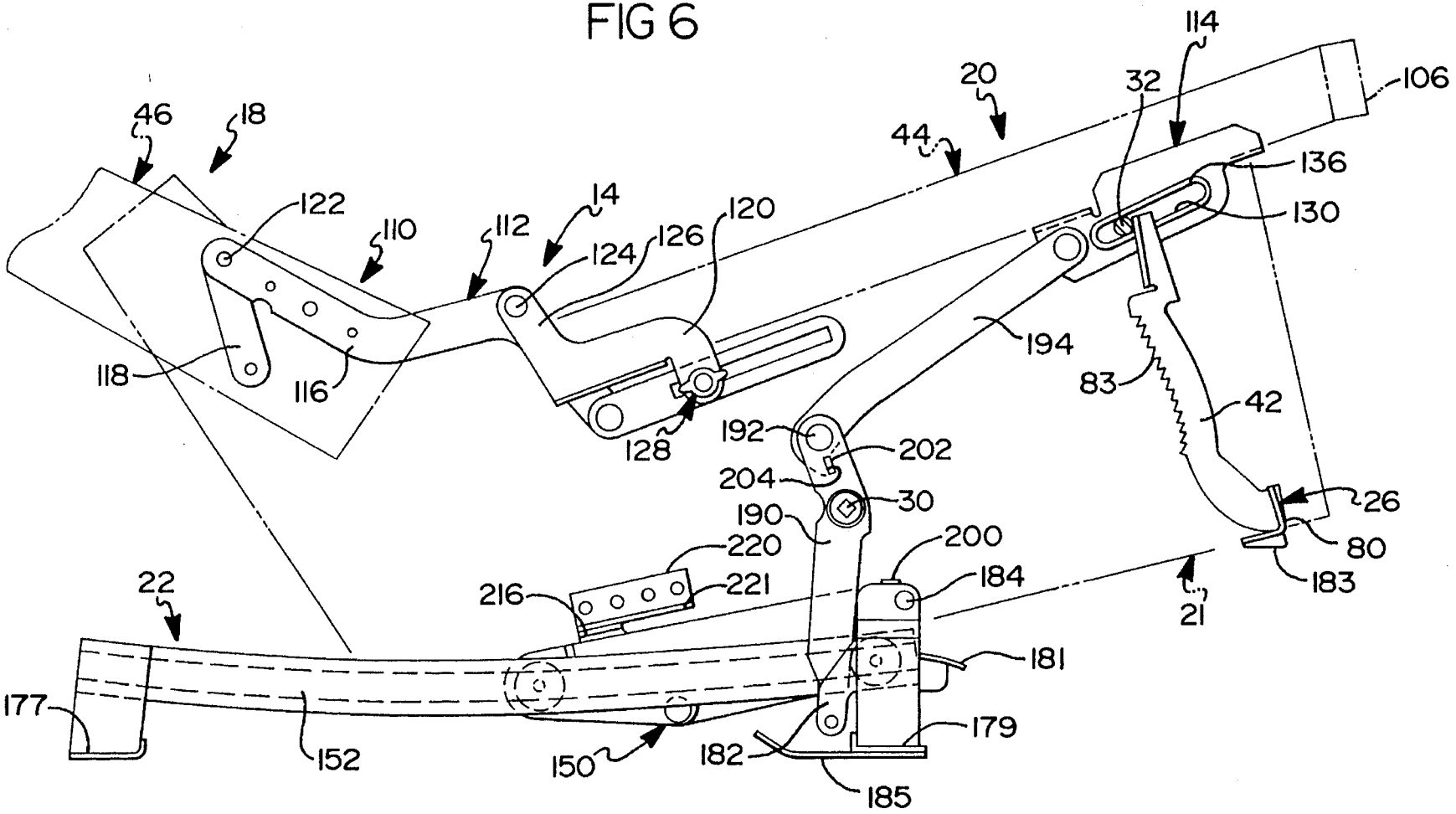
FIG. 6 is another sectional view illustrating the wall proximity reclining/tilt chair in a "leg rest extend/fully reclined" position.

As best seen in FIG. 2, 5 and 6, seat frame 44 is located between and supported for reclining movement on side frame assemblies 24. More specifically, seat frame 44 is a rigid rectangular structure having left and right side bars 104 which are rigidly secured to opposite ends of front and rear cross pieces 106 and 108, respectively. In view of the compact nature of actuation mechanism 12, seat frame 44 is non-contoured (i.e. "flat") which also permits use of loose cushions, if desired. Seat frame 44 is supported for movement relative to side frame assemblies 24 by means of a seat swing mechanism 110 for causing seat frame 44 to move substantially horizontally and slightly up or down, depending on whether seat frame 44 moves forwardly (during "reclining" movement) or rearwardly (on return to the "upright" position). Seat swing mechanism 110 includes left and right hand rear swing linkages 112 and left and right hand front slide brackets 114. Rear swing linkages 112 extend vertically well above the level of seat frame 44 along rear posts 58 of side frame assemblies 24. Each rear swing linkage 112 includes an elongated swing link 116, a support bracket 118 and a seat bracket 120. An upper end of each swing link 116 is pivotably connected just below chair arm 55 to support bracket 118 which, in turn, is fixedly secured to its corresponding side panel 50. As such, pivot points 122 between swing links 116 and support brackets 118 define a third set of "fixed" pivot or suspension points that are seated directly in side panels 50.

The lower end of each rear swing link 116 is pivoted about a pivot point 124 to an upstanding post section 126 of seat bracket 120. Seat bracket 120 has a horizontal flange portion that is securely fixed (such as by wood screws) to an underside surface of a seat side bar 104 in relatively close proximity to the back end of seat frame 44. As such, loading on the rear of seat frame 44 passes from seat brackets 120 and pivots 124 into rear swing links 116 as tension loading which is transferred by way of pivots 122 and support brackets 118 into side frame assemblies 24 of chair 10. Rear swing link s 116 are elongated to provide increased leverage for balanced reclining action. Thus, the rear of seat frame 44 moves much like a controlled pendulum on and below upper pivots 122. As will be appreciated, the particular length of rear swing links 116 and the position of pivot point 122, can be selectively varied to compensate for increased frictional resistance due to upholstery of the reclining seat assembly 14 rubbing against stationary upholstery. While not considered necessary to provide superior balanced comfort, left and right tension mechanism 128 may be installed between seat bracket 120 and a lower end of swing link 116 to provide means for adjusting the resistance to reclining movement of seat assembly 14.

As mentioned, seat swing mechanism 110 also includes a pair of (i.e. left and right) front slide brackets 114 which are operable to guide the fore and aft movement of seat frame 44 and, in turn, seat member 20. As best seen from FIGS. 3 and 4, the opposite ends of front support shaft 32 extend through lost-motion slots 130 formed in left and right slide brackets 114 which have horizontal flanges 132 securely fixed (such as by wood screws) to an underside surface of seat side bars 104 in relatively close proximity to the front end of seat frame 44. In addition, slide brackets 114 also include elongated vertical flanges 134 which are adapted to be retained against the inner side surface of seat side bars 104. As will be appreciated, the angularity and length of slots 130 define the range of fore and aft movement of seat frame 44 relative to chair body 21 upon the seat occupant applying a force to move seat assembly 14 between the "upright" and "reclined" positions. In addition, means are also provided for limiting the amount of frictional drag upon movement of seat frame 44 with respect to support shaft 32. In particular, a nylon insert 136 is fixedly retained within each lost-motion slot 130. Nylon insert 136 is operable for minimizing frictional resistance to movement of the front end of seat member 20 with respect to support shaft 32 while concomitantly acting to effectively dampen noise. A pair of spacer clips 138 are provided on opposite ends of support shaft 32 for preloading a spring 139, retained between a pair of disk-like washers 140, against an inner surface of nylon inserts 136 and adjacent to slots 130. The preload exerted by spring 139 can be selected to exert a biasing force on the outer washer 140 which bears directly against nylon insert 136. In addition, disk-like washers 140 and spacer clips 138 serve to align seat frame 44 in a "side-to-side" manner. Spacer clips 138 also act to positively locate and retain pantographic leg rest linkages 34 on support shaft 32. Therefore, slide brackets 114, nylon inserts 136, disk-like washers 140, and spacer clips 138 are pre-assembled onto support shaft 32.

With particular reference again to FIG. 2, the construction of seat back 18 is shown to include a seat back frame 46 that is in the form of a rigid relatively rectangular assembly. Seat back frame 46 includes right and left hand side members 142 and upper and lower cross-pieces 144 and 146, respectively. As is known, seat back frame 46 can be removably mounted on an upper portion of rear swing links 116 by means of slide brackets 148 secured at suitable locations on side members 142. A preferred construction of slide brackets 148 for this type of mounting is shown and described in commonly owned U.S. Pat. No. 5,184,871 which issued on Feb. 9, 1993 and is entitled "Detachable Chair Back Brackets". In general, slide brackets 148 are channel-shaped to provide an interior track that slidably receives rear swing links 116 therein. When slide brackets 148 are mounted on rear swing links 116, seat back 18 is, in effect, an extension of rear swing links 116 above pivot points 122. As such, seat back 18 can be pivoted about pivot points 122 for causing relatively easy angular movement of rear swing links 116. The primary means of moving rear swing links 116 is the application of pressure against seat back frame 44 above the level of pivot point 122, as when the seat occupant leans backward in seat assembly 14. As will be described hereinafter, this action causes seat back frame 44 to pivot backwardly for causing rear swing links 116 to swing forwardly for initiating rolling forward movement of left and right wheeled bearing link assemblies 150 in curved tracks 152 on base assembly 22. Since bearing link assemblies 150 are secured to chair frame 21, such action results in chair frame 21 moving forwardly and tilting on base assembly 22.

As best seen from FIGS. 2, 5 and 6, leg rest assembly 16 includes a frame board 48 having an outer surface that is padded and upholstered so that upon completion, wall proximity reclining/tilt chair 10 will be as seen in FIGS. 1A through 1D. Frame board 48 is supported and moved by identical left and right hand pantograph linkages 34. Pantograph linkages 34 are substantially identical in function and structure to that shown in FIG. 3 of U.S. Pat. No. 3,096,121, assigned to the common assignee of the present invention, with the exception that pantograph linkages 34 are operably suspended about the second set of "fixed" suspension points defined by support shaft 32. Such a suspension arrangement for leg rest assembly 16 is clearly shown and described in U.S. Pat. No. 5,222,286. The extensible action of leg rest assembly 16 takes place simultaneously for both the left hand and right hand pantograph linkages 34 when there is sufficient angular rotation of drive rod 30 via handle 43. In this manner, frame board 48 is moveable between its "stowed" vertical position and its "extended" horizontal position. In addition, other leg rest assembly configurations, such as, for example, that disclosed in U.S. patent application Ser. No. 08/319,671 filed Oct. 10, 1994 and entitled "Dual Leg Rest Assembly", can be utilized with reclining/tilt chair 10 of the present invention.

According to the particular embodiment shown, a ratchet-type detent mechanism 160 interconnects drive rod 30 and support shaft 32 for providing various intermediate locked positions for leg rest assembly 16 between its "stowed" and "extended" positions. Generally, detent mechanism 160 provides three distinct locking positions for leg rest assembly 16 that can be established independent of the reclined/tilted position of chair 10. More particularly, detent mechanism 160 is a modified version of that shown in commonly owned U.S. Pat. No. 3,325,210 entitled "Adjustable Leg Rest Locking Device" and U.S. Pat. No. 4,367,895 entitled "Reclinable Chair". To this end, the structure of ratchet mechanism 160 includes a coil spring 162 having a first end journalled on support shaft 32. As seen in FIG. 3 and 4, a spacer clip 164 maintains proper spacing of coil spring 162 on support shaft 32. The lower end of coil spring 162 is pivotably coupled to a first end of an inclined link 166.

Figure 9A:
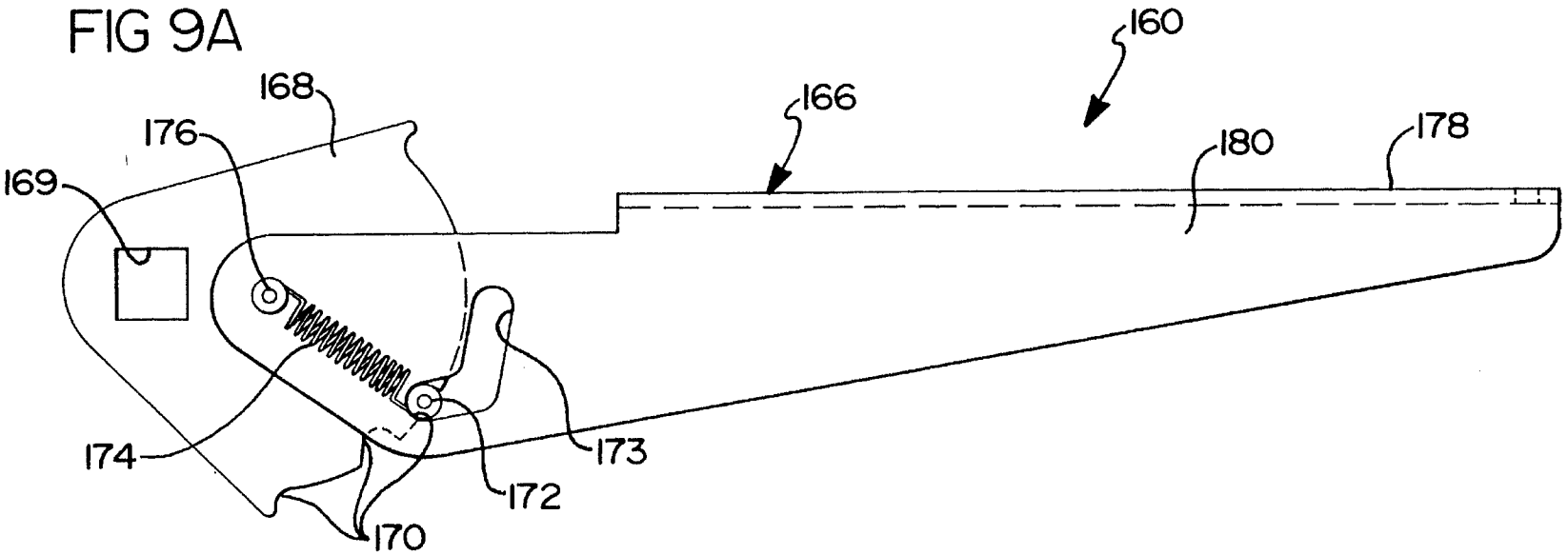
FIGS. 9A and 9B are enlarged side and bottom plan views, respectively, of the three-position leg rest mechanism shown in FIG. 2.
Figure 9B:
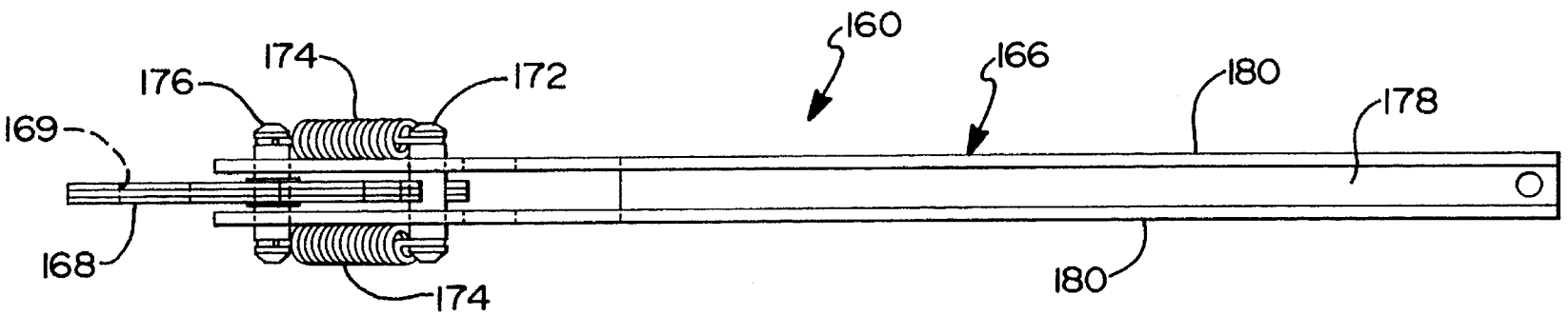

Additionally, FIGS. 9A and 9B show inclined link 166 to include a bifurcated portion which receives a sector-shaped ratchet plate 168 that is mounted by way of a square hole 169 on drive rod 30 so as to rotate therewith. Ratchet plate 168 has a specially shaped outer peripheral surface defining a series of locking recesses 170. In addition, recesses 170 cooperate with a floating detent pin 172 carried in L-shaped guideways 173 formed between the bifurcated segments of inclined link 166. Detent pin 172 is biased into one of locking recesses 170 by a pair of tension springs 174 anchored on a pivot pin 176 between ratchet plate 168 and inclined link 166. Preferably, inclined link 166 is generally U-shaped in cross-section and includes a top segment 178 integrally connecting a pair of parallel side segments 180. Top segment 178 does not extend along the entire length of inclined link 166 such that parallel side segments 180 define the open-ended bifurcated portion thereof and through which the L-shaped guideways 173 are formed. When drive rod 30 is rotated to operate leg rest assembly 16, ratchet plate 168 is also rotated to expose different locking recesses 170 to detent pin 172 depending upon the degree of rod rotation and the elevation of leg rest 16. When detent pin 172 is lockingly biased into one of locking recesses 170, leg rest assembly 16 is releasably locked in a corresponding elevated position against inadvertent angular movement by mechanism 160. Coil spring 162 serves to provide an element of cushioning or relief, without damaging detent mechanism 160 and actuation mechanism 12, if excess loading is placed on leg rest assembly 16 in one of the intermediate positions. Furthermore, leg rest assembly 16 can only be returned to its "stowed" position from an intermediate position by fully protracting leg rest assembly 16. Thereafter, reverse rotation of handle 43 cause pantograph linkages 34 to return to their "stowed" position.

In accordance with another feature of the present invention, left and right push link mechanisms 178 are provided which work in conjunction with seat swing mechanism 110 for causing translational "fore and aft" movement of bearing linkage assemblies 150 in tracks 152 and, in turn, translational movement of chair frame 21 relative to base assembly 22 in response to the pressure applied by the seat occupant to seat back 18. In general, push link mechanisms 178 are interconnected between a front cross bar 179 of base assembly 22 and a forward portion of seat frame 44. More particularly, each push link mechanism 178 includes a base bracket 180 that is fixed to front cross member 179 of base assembly 22 such that a first end of a lower push link 182 is pivotally connected at pivot 184 to an upper offset end portion thereof. The opposite end of lower push link 182 is pivotally connected at a pivot 188 to a first end of a drive rod swing link 190 which is journally supported, at an intermediate portion thereof, on drive rod 30. The opposite end of drive rod swing link 190 is pivotally connected at a pivot 192 to the lower end of an upper pull link 194, the upper end of which is pivotally connected at a pivot point 196 to its corresponding front slide bracket 114 mounted on a side bar 104 of seat frame 44. Preferably, drive rod swing link 190 has an aperture through which a spacer sleeve 197 is disposed and which is concentrically supported on square drive rod 30. Thus, square drive rod 30 fixes the longitudinal position of drive rod swing link 190 and upper pull link 194 but is independently operable with respect to angular movement thereof. As such, when pressure is applied by the seat occupant to move seat assembly 14 between the "upright" position and the "reclined" position, push link mechanisms 178 work in synchronism to cause corresponding fore and aft translational movement of chair frame 21 on base 22 via movement of bearing linkage assemblies 150 within curved tracks 152. In addition, the slight curvature of tracks 152 causes chair frame 21 to tilt rearwardly relative to the floor upon forward translational movement thereof. As best seen from FIGS. 5 and 6, the opposite ends of curved tracks 152 are fixedly secured to base assembly 22 via mounting brackets fixed to front cross bar 179 and a rear cross bar 177.

In addition to the above, push link mechanisms 178 include a unique means for limiting the "range" of translational fore/aft movement of chair frame 21 relative to base assembly 22 and, in turn, provide a means for limiting the range of reclining movement of seat assembly 14 relative to chair frame 21. In particular, the rearward limit of translational movement of chair frame 21 on base assembly 22 is established upon engagement of an upper surface 198 on each lower push link 182 with a stop flange 200 extending from a top end of each base bracket 180. As best seen from FIG. 3, stop flanges 200 are integrally formed on the upper offset portion of base brackets 180 so as to be selectively engageable with lower push links 182, for establishing the totally "upright" relationship of chair frame 21 on base assembly 22. Moreover, the contour provided on the portion of upper push link surface 198 aligned to engage stop flanges 200 may be selectively modified to provide further assistance in establishing the rearward limit for translational movement of chair frame 21 on base assembly 22. Such motion-limiting engagement between lower push links 182 and stop flanges 200 may, if desired, coincide with engagement of support shaft 32 with the forward edge of guide slots 130 in slide brackets 114 to further assist in establishing a desired limit to the rearward movement of chair frame 21 on base assembly 22.

To define the forward limit of translational movement of chair frame 21 relative to base assembly 22, push link mechanisms 178 also includes a stop projection 202 provided on each swing link 190 that is engageable with a stop edge 204 formed at the distal end of each upper pull link 194. As such, the limit for full forward movement of chair frame 21 on base assembly 22 is established when stop projections 202 engage stop edges 204, thereby establishing the fully "reclined/tilted" position. This arrangement is most clearly shown in FIG. 6 from which it can also be seen that, upon such motion-limiting engagement, support shaft 32 is not in engagement with the rearward edge of guide slots 130 in slide brackets 114. Thus, the "range" of reclining movement available with actuation mechanism 12 is not predicated on the length of guide slots 130 in front slide brackets 114. Rather, push link mechanisms 178 provide means for positively establishing both the rearward and forward limits of travel for chair frame 21 on base assembly 22. Thus, guide slots 130 can be universally configured for application to many different chair designs while the particular amount of recline motion for each chair is controlled by other means as described.

With particular reference now to FIGS. 3 through 8, the primary components of actuation mechanism 12 which produce the "tilting" movement characteristics will now be described in more detail. As noted, actuation mechanism 12 includes left and right wheeled bearing link assemblies 150 provided for movably supporting chair frame 21 for translational "fore and aft" movement relative to curved tracks 152 of base assembly 22. Moreover, the fore and aft movement of chair frame 21 causes substantially simultaneous corresponding reclining movement of seat assembly 14 and tilting movement of chair frame 21. In addition, wheeled bearing link assemblies 150 are respectively coupled to left and right tilt linkage mechanisms 206 for causing independent tilting movement of chair frame 21 upon corresponding actuation of leg rest assembly 16 via rotation of drive rod 30. As will be appreciated, upon raising leg rest assembly 16 to an intermediate position, such as by detent mechanism 160, tilt linkage mechanisms 206 only produce a proportional amount of tilting movement.

Figure 8A:
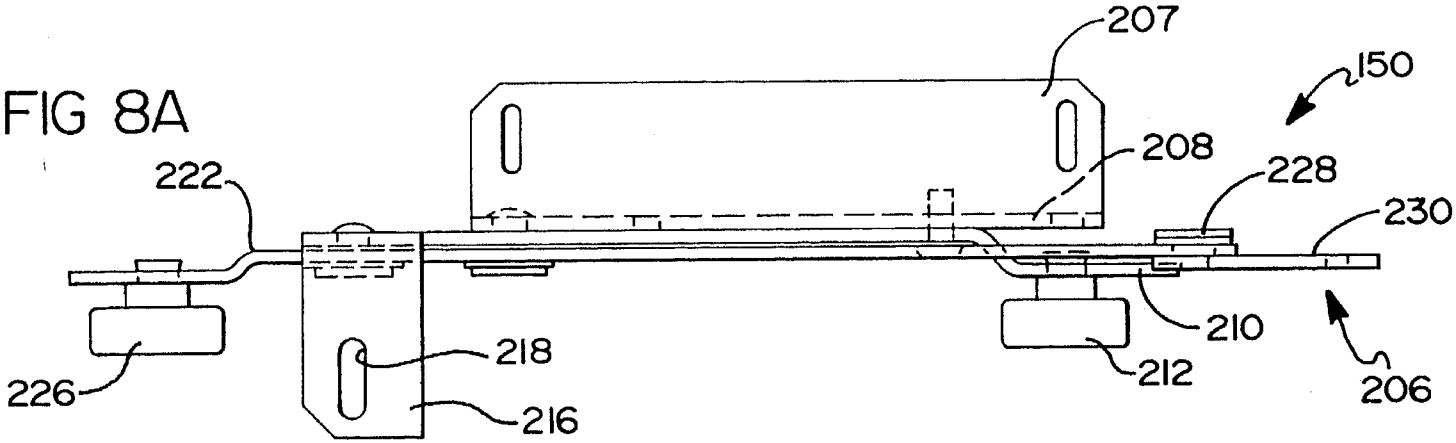
FIGS. 8A and 8B are enlarged plan and side views, respectively, of the left hand bearing link as assembly shown in FIG. 2.
Figure 8B:
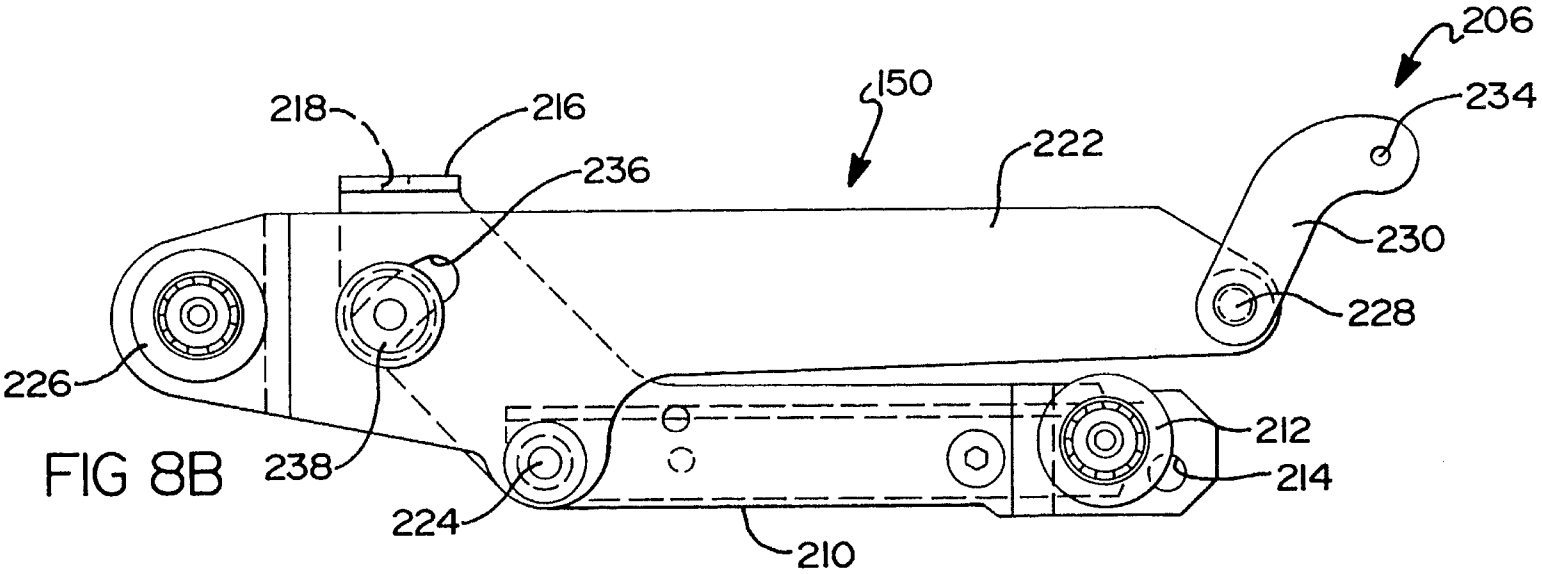

Left and right bearing link assemblies 150 are mirror-imaged wheeled assemblies disposed respectively for rolling movement in left and right curved tracks 152 of base assembly 22. Preferably, curved tracks 152 are aligned in parallel relationship and may be slightly downwardly curved from back to front to generate a "balanced" rolling movement of the wheeled units therein. As best seen in FIGS. 8A and 8B, bearing link assemblies 150 each include an angled flange bracket 207 adapted to be securely affixed directly to the bottom edge surface of horizontal bottom members 54 of chair frame 21 such as by wood screws. Moreover, each flange bracket 207 is fastened to bottom member 54 to support the weight of chair frame 21 as well as the seat occupant without producing sheer forces on the fasteners. Flange bracket 207 includes a downwardly extending flange 208 connected to a bearing link member 210 having a forward wheeled rolling unit 212 supported thereon and which is adapted to be rollingly disposed within tracks 152. Alternatively, front wheeled rolling unit 212 can be secured to a lower mounting aperture 214 to tilt chair frame 21 in a slightly more rearward orientation when chair 10 is in the "upright" position.

The method of fastening bearing link assembly 150 to bottom member 54 may not be as effective when a chair frame 21 with a side panel 50 having reduced thickness are utilized because the threaded fastener can cause side panel 50 to split. Similarly, cross-doweling is not desirable since it requires additional manufacturing steps making the chair more labor intensive and thus, more expensive to assemble. Furthermore, cross-doweling may not provide a sufficiently strong connection between the chair frame and the bearing link assembly. Thus, an alternate embodiment for the bearing link assembly of the present invention is illustrated in FIGS. 8C through 8E which is adapted to be used in conjunction with reduced thickness side panels 50' of side frame assembly (not shown).

Figure 8C:
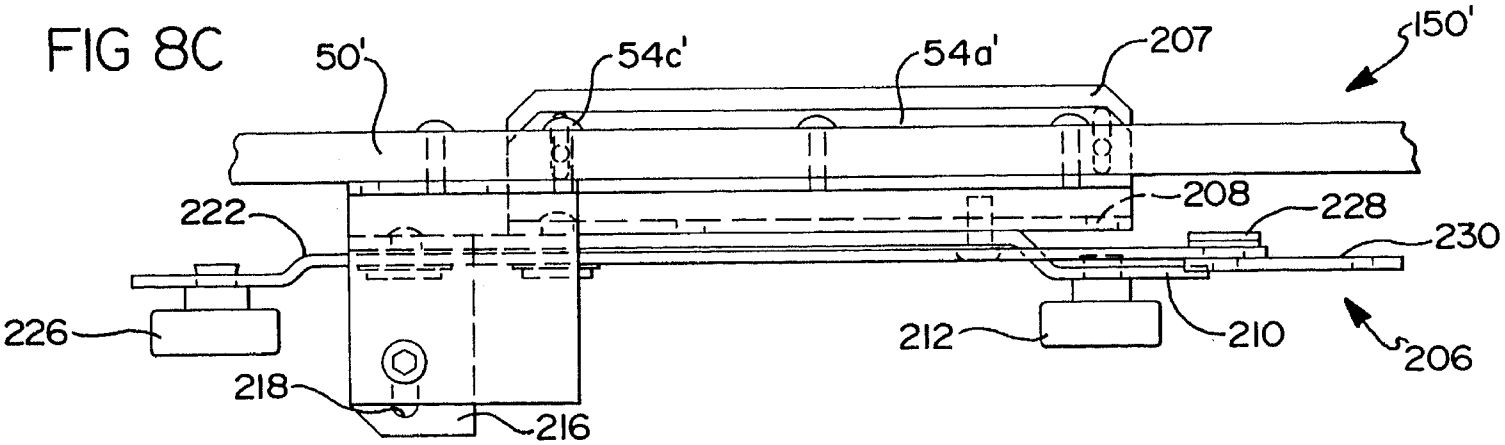
FIGS. 8C through 8E are enlarged plan, side and cross-sectional views, respectively, of an alternate embodiment of the left hand bearing link assembly shown in FIGS. 8A and 8B.
Figure 8D:
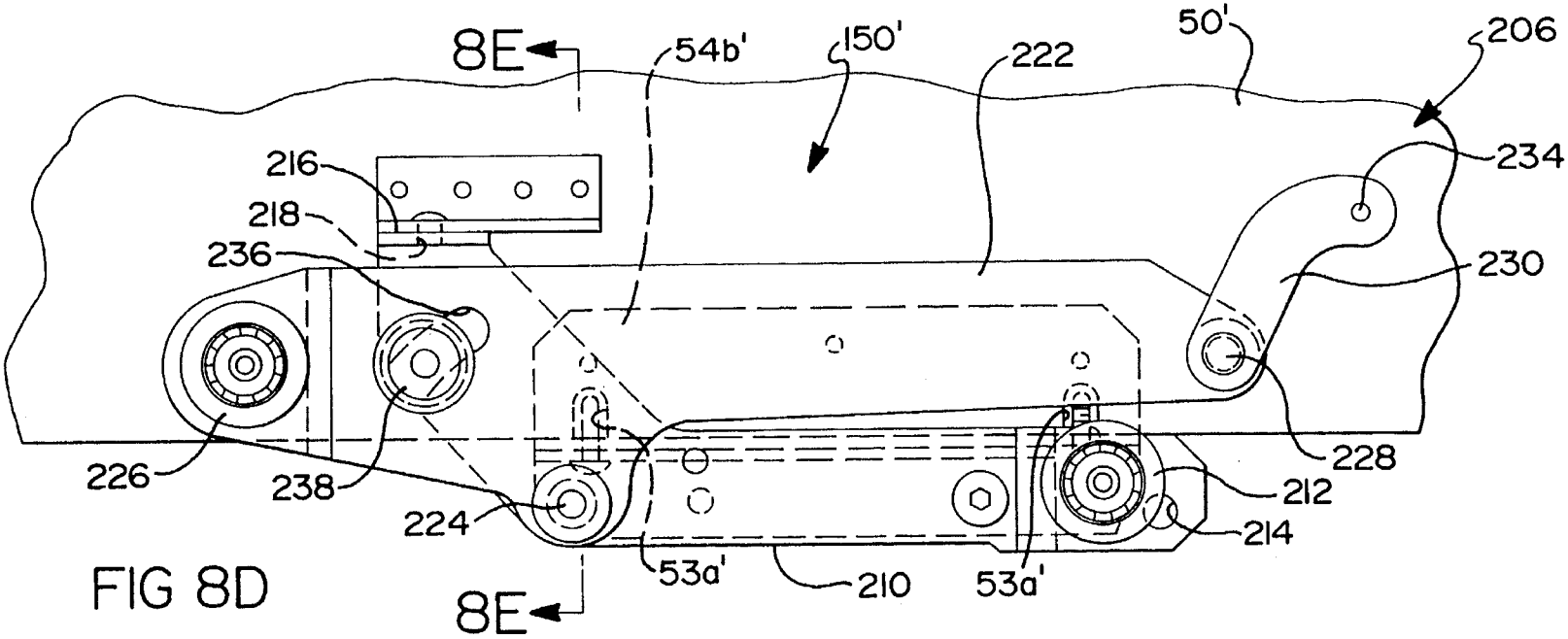
Figure 8E:
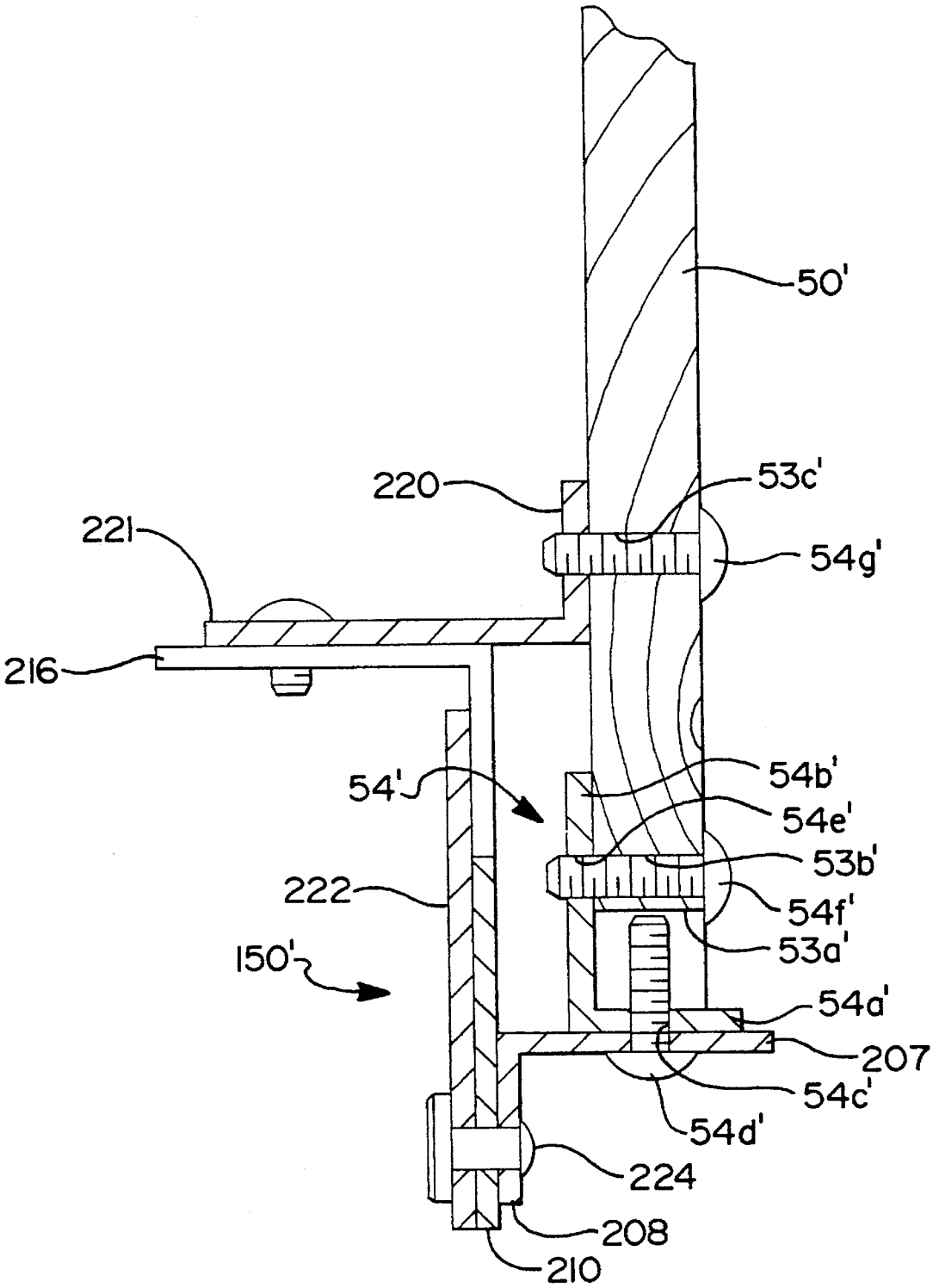

Referring now to FIGS. 8C through 8E, bearing link assembly 150' is substantially similar to bearing link assembly 150 with the modifications relating to the use of mounting bracket 54' for securing side panel 50' to angled flange bracket 207. More specifically, mounting bracket 54' is an L-shaped bracket having first portion 54*a*' abutting flange bracket 207 and second portion 54*b*' extending upwardly perpendicular from flange bracket 207. Threaded aperture 54*c*' is formed in first portion 54*a*' for receiving threaded fastener 54*d*' to secure mounting bracket 54' to angled flange bracket 207. Similarly, threaded aperture 54*e*' is formed in second portion 54*b*' for receiving threaded fastener 54*f*' to secure mounting bracket 54' to side panel 50'. Recess 53*a*' extends through side panel 50' at the location of fastener 54*d*' for providing clearance for the threaded portion of fastener 54*d*' which extends above first portion 54*a*'. Likewise, apertures 53*b*' and 53*c*' extend through side panel 50' to receive threaded fasteners 54*f*' and 54*g*' respectively to secure side panel 50' to bearing link assembly 150'. As will be appreciated, recess 53*a*' and apertures 53*b*' and 53*c*' may be drilled simultaneously with bores 60, 64, 78 and 96 as heretofore discussed to further enhance hole location accuracy and hence the pre-assembled quality of the present invention.

In a preferred method of assembly, mounting bracket 54' is secured to side panel 50' with fasteners 54*f*' which is then subsequently positioned on and secured to angled flange bracket 207. Side panel 50' is then secured to angled bracket 220 of bearing link assembly 150'. In this way side panel 50' is supported from underneath and positively affixed to bearing link assembly 150' without weakening the structure or unduly loading fasteners 54*f*' and 54*g*' in shear which can effect the structural integrity of the interface between the chair frame and the bearing link assembly. Furthermore, mounting bracket 54' and threaded fasteners 53*a*' provide additional strength and rigidity between side panel 50' and bearing link assembly 150'. As a result, the weight of the chair and a seated occupant is effectively and efficiently transferred through bearing link assembly 150' to curved tracks 152.

With continued reference to the first preferred embodiment illustrated in FIGS. 8A and 8B, the upper rear end of bearing link 210 has a right-angled flange 21 6 having at least one elongated slot 218 provided for securely attaching bearing link 210 to an angled bracket 220 (FIGS. 5 and 6) which is secured to an inner vertical surface of side panel 50. Angled bracket 220 has a horizontal flange 221 on which are formed a series of aligned apertures (not shown). Accordingly, elongated slot 218 on bearing link flange 216 and the apertures formed on flange 221 of angled bracket 220 permit selective side-to-side adjustment of bearing link assemblies 150 to compensate for manufacturing tolerances in base assembly 22 and/or chair frame 21. A pivot lever 222 is pivotally connected to bearing link 210 and angled link bracket 207 about pivot point 224. More particularly, pivot lever 222 includes a second rear wheeled unit 226 that is adapted to be rollingly disposed in tracks 152. The opposite end of pivot levers 222 are secured to respective left and right "tilt" linkages 206, the structure and operation of which will be described hereinafter. Therefore, the weight of the seat occupant and the center of gravity of seat assembly 14, defined by the orientation of front and rear wheeled units 212 and 226 disposed within curved tracks 152, combine to generate a forwardly directed force on bearing link assemblies 150 which tends to augment the limited occupant input (i.e, pressure to seat back 18) required for causing smooth operation of actuation mechanism 12.

With continued reference to FIGS. 8A and 8B, each bearing link assembly 150 is shown to be operatively coupled to a tilt linkage mechanism 206 for "tilting" chair frame 21 relative to the floor upon movement of leg rest assembly 16. In general, tilt linkage mechanisms 206 interconnect pivot levers 222 of bearing link assemblies 150 to drive rod 30. More particularly, the forwardmost end of each pivot lever 222 extends below and is generally aligned with the axis of drive rod 30 and is pivotally connected at a pivot 228 to a lower end of a J-shaped toggle link 230. The other end of J-shaped toggle link 230 is pivotally connected to a connector link 232 at pivot point 234 and which, in turn, is secured on drive rod 30 for angular movement therewith. Preferably, connector link 232 is pre-assembled onto drive rod 30 such that final connection to toggle link 230 and, in turn, bearing link assemblies 150 can be accomplished during modular assembly of reclining/tilting chair 10.

In operation, tilt linkage mechanisms 206 inhibit tilting movement of chair frame 21 until handle 43 and, in turn, drive rod 30 are rotated for causing pivotal movement of pivot levers 222 relative to bearing links 210. More particularly, pivot levers 222 are formed with a lost motion slot 236 through which a rivet 238, extending through bearing link 210, moves to define a limited range of angular movement between pivot levers 222 and bearing links 210. Therefore, upon rotation of drive rod 30, the corresponding rotation of connector link 232 cause toggle link 230 to drive the forward end of pivot levers 222 downwardly. At this point, the mechanical advantage of tilt linkage mechanisms 206 act to forwardly drive J-shaped toggles 230 around and below drive rod 30 so as to permit pivot levers 222 to pivot about pivot points 224 such that bearing link assemblies 150 and, in turn, chair frame 21 are "tilted" relative to tracks 152. In addition, rivets 238 provide structural support to chair 10 for maintaining the alignment and rigidity of pivot levers 222 for causing rear wheeled units 226 to run straight within tracks 152. As such, lateral (i.e., side-to-side) cross-members can be eliminated since the rigidity of chair frame 21 is used to maintain correct wheel alignment relative to track 152.

With reference to FIG. 3, an exemplary construction for spring-assist toggle assembly 36 is shown which works coactively with leg rest pantograph linkages 34 for securely holding frame board 48 of leg rest assembly 16 in a fully retracted position against front rail assembly 26. Toggle assembly 36 is also operable to supply a spring force for biasingly urging leg rest assembly 16 toward one of its extended and retracted positions. Toggle assembly 36 includes a toggle lever 240 with a square hole which is mounted by means of the square hole on square drive rod 30 for rotation therewith. Toggle lever 240 is pivotally connected at pivot 242 to rear leg of a C-shaped toggle link 246 that curves around, under and toward the front of drive rod 30 where its front leg has an opening to which one end of a helical coil spring 248 is attached. The opposite end of spring 248 is attached to a spring connection link 250 which is journally secured by means of a circular aperture to support shaft 32. In this manner, toggle assembly 36 can be completely preassembled as part of actuation mechanism 12. The location of pivot 242 above drive rod 30 and the line of action of spring 248 are such that in the retracted position of leg rest assembly 16, the spring force acts to biasingly hold or "retain" leg rest assembly 16. As leg rest 16 is initially extended upon slight rotation of actuator lever 46 and, in turn, drive rod 30, pivot 242 moves down and over center of an imaginary line between the axis of the support shaft 32 and the drive rod axis. Once pivot 242 is over-center, tension loading on spring 248 assists in drivingly rotating drive rod 30 for elevating leg rest assembly 16 as the forward leg of link 246 is pulled toward spring connection link 250 and support shaft 32. In addition, spring 248 assists the seat occupant in pivoting handle 43 through the required actuation angle. More particularly, connection of spring-assist toggle assembly 36 between support shaft 32 and drive rod 30 places the spring force in close alignment to cross brace 38 minimizing deflection of drive rod 30 due to spring force which, in turn, causes easier handle rotation. In similar fashion, toggle assembly 36 is adapted to utilize the spring biasing force of spring 248 to assist in returning leg rest assembly 16 to its stowed position upon reverse rotation of handle 43. While not shown, tension adjustment means may be optionally provided for adjusting the tension in spring 248. The spring connection link 250 of toggle assembly 36 is positively located on support shaft 32 by means of spacer clip 244 for maintaining the desired spacing between toggle assembly 36, pantograph linkage 34 and front slide bracket 114.

In accordance with the principles of the present invention, a method for assembling the various "modular" pre-assembled frame components and actuation mechanism 12 into reclining/tilt chair 10 will now be described in greater detail. In addition, the improved method of the present invention permits sequential assembly of the pre-assembled and/or upholstered components in a simple and efficient manner for significantly reducing overall system complexity, weight, and cost while promoting superior quality and reliability. For a more detailed disclosure of the assembly method, reference can be made to commonly owned U.S. Pat. No. 5,323,526.

Figure 10A:
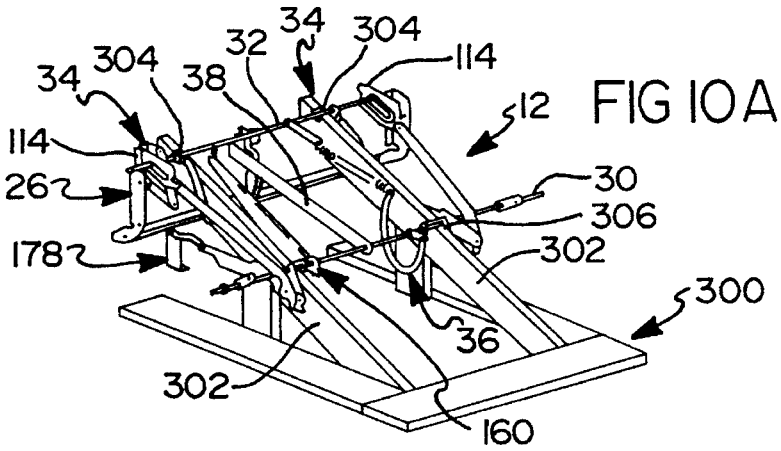

With particular reference now to FIG. 10A, pre-assembled actuation mechanism 12 is shown retained on a suitable holder or "jig" 300. Jig 300 includes a pair of spaced and angularly extending stations 302 having first and second sets of aligned notches 304 and 306, respectively. As can be seen, the first set of aligned notches 304 is provided for retaining support shaft 32 therein while the second set of aligned notches 306 is provided for retaining drive rod 30 therein. As previously noted, the various components associated with slide brackets 114, pantograph linkages 34, push link mechanisms 178, cross-brace 38, front rail assembly 26, ratchet mechanism 160 and toggle assembly 36 are all operably coupled to, or suspended from, actuation mechanism 12 prior to interconnection with the various frame components. Alternatively, jig 300 may be used as an appropriate situs for assembling the various linkages and components associated with actuation mechanism 12. In addition, jig 300 may include side portions (not shown) extending vertically from the outboard edges of base 300 to align components of front cross rail assembly 26 relative to the components of actuation mechanism 12 such that lower cross-member 80, end segments 82 and center segment 42 are perpendicularly situated with respect to drive rod 30 and support rod 32, while maintaining drive rod 30 and support shaft 32 in parallel alignment. Once appropriately positioned, front cross rail assembly 26 is secured to support rod 32 and cross-brace 34 with threaded fasteners to form a rigid, unitary assembly suspended from jig 300, as best seen in FIG. 10A.

Figure 10B:
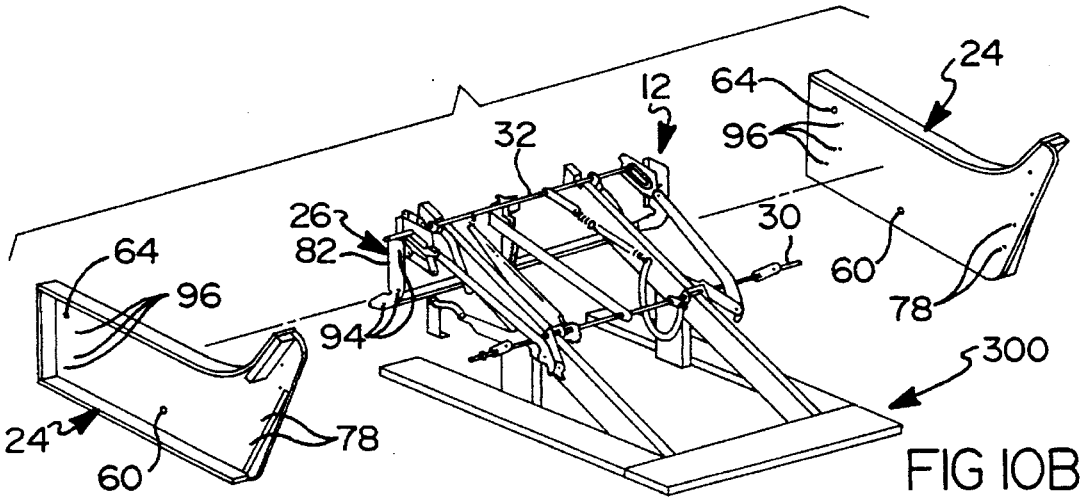

With reference now to FIG. 10B, the assembly step for orienting and interconnecting side frame assemblies 24 with actuation mechanism 12 is clearly shown. While not shown, it is to be understood that the requisite padding, lining, decorative upholstery and the like have also been installed on side frame assemblies 24 prior to assembly with actuation mechanism 12. As seen, drive rod 30 and support shaft 32 are of sufficient length such that side frame assemblies 24 can be retained thereon. More specifically, the upholstered side frame assemblies 24 are positioned on actuation mechanism 12 such that the opposite ends of drive rod 30 extend through the first set of aligned bores 60 formed in side panels 50 (i.e. the first set of "fixed" pivot points). Similarly, the opposite ends of support shaft 32 are seated with the second set of aligned bores 64 formed in side panels 50 (i.e. the second set of "fixed" pivot points). An optional coating of wax, or other suitable material to insulate the wood components of chair 10 from the metal components, can be preapplied to the portions of side panels 50 which contact or are otherwise fastened to the chair's metal components. In this manner, any noise that might be generated by relative movement at such wood and metal junctions is substantially eliminated. Such insulation material is preferably applied anywhere on chair 10 where metal contacts wood or other non-metal components.

Figure 10C:
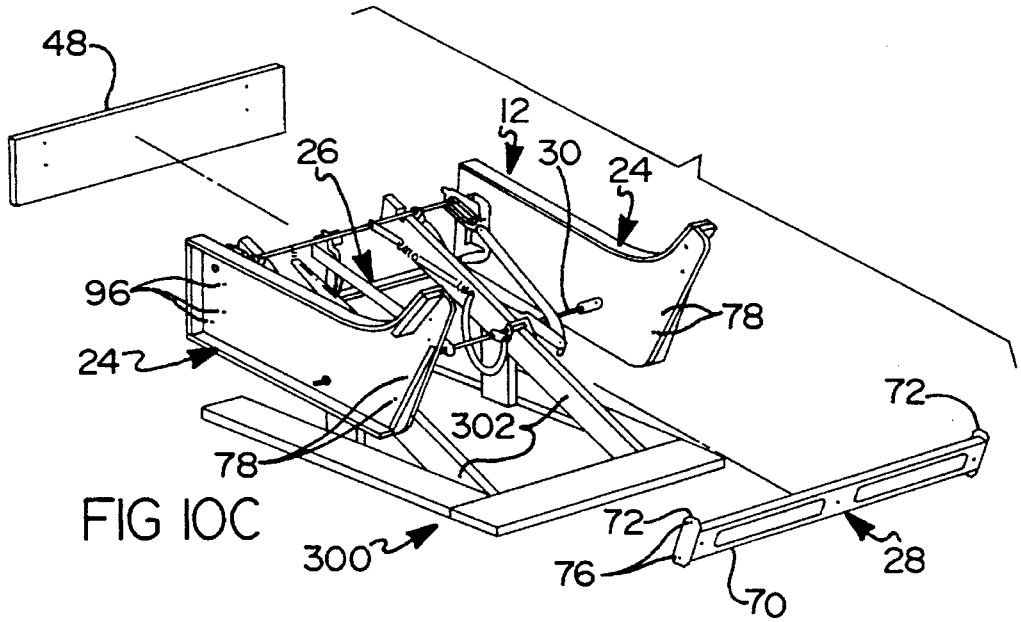

As seen in FIG. 10C, the four primary pre-assembled frame components include left and right side frame assemblies 24 and front rail assembly 26 and rear rail 28. In accordance with a preferred assembly procedure, threaded fasteners are threadably driven through aligned bores 76 in angled brackets 72 and bores 78 in side panels 50 for securing rear rail 28 between the left and right side frame assemblies 24. Complete tightening of the threaded fasteners is typically deferred until end segments 82 of front rail assembly 26 has also been secured to side frame assemblies 24. As noted, an upholstered "tailgate" (not shown) may be secured to rear rail 28 in those application wherein rear rail 28 is not upholstered. As shown, end segments 82 of front rail assembly 26 have been pre-assembled onto the ends of lower cross-member 80. Self-tapping fasteners are threadably driven through bores 96 formed in side panels 50 and into non-threaded bores 94 formed in angled brackets 92 of end segments 82 for rigidly securing side frame assemblies 24 to front rail assembly 26. Thereafter, if not previously secured, cross-brace bracket 40 is fixedly attached to top portion 98 of center segment 42 of front rail assembly 26 to provide additional structural rigidity. Alternatively, end segments 82 can be pre-assembled onto side panels 50 and then secured to lower cross rail and support shaft 32.

Thus, FIG. 10C illustrates the integrated and interdependent relationship of the four primary frame components which, when assembled, define an extremely rigid "box-like" upholstered chair body 21 within which actuation mechanism 12 is suspended. As noted, this "integrated" construction permits the elimination of the separate mechanism frame assembly conventionally provided for supporting the actuation mechanisms in prior known reclining chairs. As seen, jig 300 is designed to permit the various frame components to be interconnected in an extremely efficient manner. Following assembly of chair body 21, frame board 48 is fixedly secured to angled brackets of pantograph linkages 34. Again, it is to be understood that frame board 48 has been pre-assembled as an upholstered unit prior to being assembled as part of chair body 21.

Figure 10D:
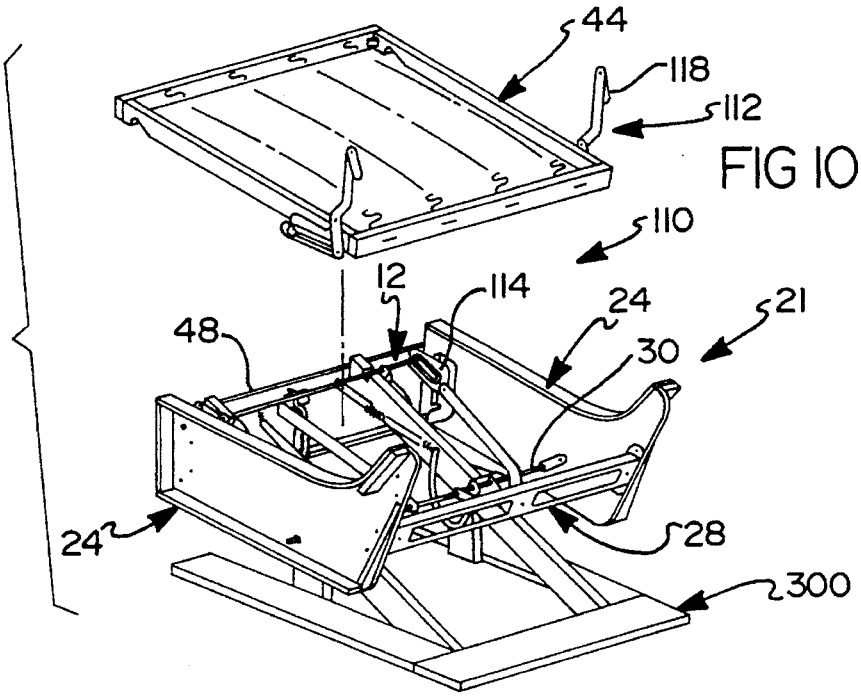

With particular reference now to FIG. 10D, the four pre-assembled frame components defining chair body 21 are shown supported from jig 300 with actuation mechanism 12 integrally suspended therefrom. In accordance with the next operation, upholstered seat member 20 (which includes seat frame 44 with its appropriate upholstery padding and springs) is interconnected to chair body 21. While not critical, notches may be formed in the front underside edges of seat frame side bars 104 for aligning seat frame 44 with respect to support shaft 32. Next, rear swing linkages 112, which have been pre-assembled onto seat frame 44 of upholstered seat member 20, are fixedly secured to side panels 50 via support brackets 118. Once support brackets 118 are fixedly secured to side panels 50 (via suitable threaded fasteners), pivot points 122 between swing links 116 and support brackets 118 are operable to define the third set of "fixed" pivot points about which seat assembly 14 is reclinable. Alternatively, support brackets 118 of rear swing linkages 112 can be initially mounted directly to side panels 50 such that angled brackets 120 can be thereafter secured to upholstered seat member 20. In this manner, seat member 20 can be "flipped over" to permit seat brackets 120 to be securely fastened to side bars 104 of seat frame 44. With seat frame 44 positioned such that support shaft 32 is properly located, slide brackets 114 are pulled inwardly until vertically extending flanges abuttingly engage the inner surface of seat frame side bars 104. Thereafter, suitable fasteners (such as wood screws) are driven through holes in horizontal flanges to securely fix slide brackets 114 to an underside surface of seat side bars 104.

Figure 10E:
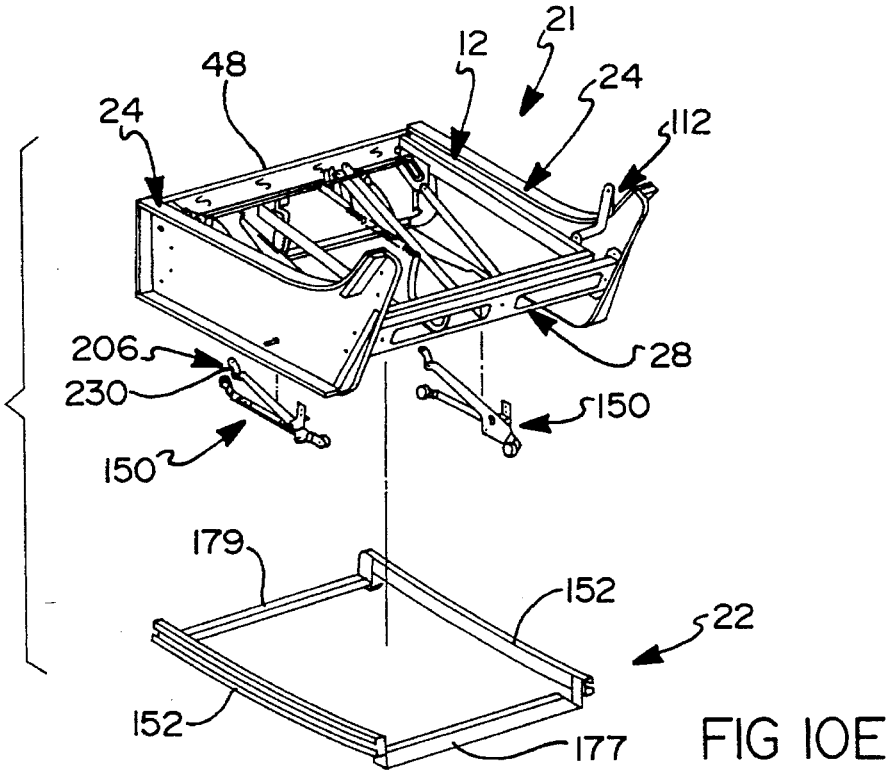

With particular reference now to FIG. 10E, rigid chair body 21 is removed from jig 300 for attaching bearing link assemblies 150 and base assembly 22. Preferably, this is accomplished by setting chair body 21 in an upside down position on its arms and orienting bearing link assemblies 150 relative thereto and affixing assemblies 150 with suitable fasteners to the bottoms of side frame assemblies 24, but not yet tightening such fasteners. Thereafter, pivot connections 234 between toggle links 230 and connector links 232 of tilt linkages 206 is made via a pair of self tapping rivets. In this manner, tilt linkages 206 and bearing link assemblies 150 are operably coupled to actuation mechanism 12. Then, base assembly 22, preassembled and having bores provided in front cross bar 179 for attaching lower flange portions of push linkage base brackets 180, is oriented relative to the base of chair body 21 for inserting wheeled units 212 and 226 of bearing link assemblies 150 in the channels of tracks 152. Preferably, this is accomplished by slidably inserting tracks 152 of base assembly 22 over wheeled units 212 and 226 of the laterally spaced bearing link assemblies 150. Thereafter, brackets 180 of push linkages 178 are fixedly secured, along with swing guards 185 (designed to protect carpeting and other floor covering from swing linkages 178) to front cross bar 179. Angled stop brackets 181 on base bracket 180 of base assembly 22 are then adjustably aligned, if necessary, by means of a slot in base bracket 180 and a self-topping screw, relative to plastic ramps 183 on flange 86 of cross member segment 80 in order to make sure chair 10 is solidly stable in the upright position. Wheeled units 212 and 226 of bearing link assemblies 150 are then aligned within the channels of tracks 152 to take out any side-to-side movement of base assembly 22 relative to chair 10 as a whole. This is made possible by the slotted connections provided. Upon effecting such proper alignment, the fasteners affixing bearing link assemblies 150 to the bottom of side frame assemblies 24 are tightened. In this manner, chair body 21 is pivotally connected for "tilting" movement with respect to base assembly 22 during reclining movement of seat assembly 14. Finally, FIGS. 10F and 10G illustrate the manner in which upholstered seat back 18 can be detachably secured to upholstered seat member 20 via swing links 116 and slide brackets 148. Handle 43 can then be installed on one end of drive rod 30.

As is apparent from examination of FIGS. 10A through 10G, the preassembled components can be interconnected in a number of other acceptable sequential operations to produce "knock-down" or modular chair 10. The method of assembly disclosed herein is advantageous in that virtually all of the components can be pre-assembled "off-line" for quick and efficient modular interconnection in a highly repeatable and precise fashion. In addition to assembly of wall proximity reclining/tilt chair 10, the "knock-down" assembly method of the present invention can likewise be used to assemble the modular components of loveseats, sofas, sectional units and the like that have at least one seat section which defines a wall proximity reclining/tilt seating unit substantially similar to chair 10. For example, an inboard side frame assembly may be tapered to eliminate the arm but which still provides for the three-pivot anchorage of actuation mechanism 12. Such a modified side frame assembly would includes a reinforced bottom rail for permitting installation of a wheeled bearing link mechanism 150 thereon. Substitution of such a side frame assembly for either of left or right side frame assemblies shown in FIG. 2, with all other components being the same, would produce a seat unit that could be used as an end section on loveseats, sofas and sectionals. In addition, use of such side frame assemblies would permit use of a reclining/tilt seating unit as a center section in a sofa or sectional. In this manner, wall proximity reclining/tilt seating units, similar to chair 10 can be assembled in combination with non-reclining seating units in any desired arrangement. Preferably, such combinations of seating unit sections are assembled using a "knock-down" rail system as disclosed in commonly owned U.S. Pat. No. 5,234,253 entitled "Mounting Apparatus For A Modular Sofa Assembly". Similarly, the connector systems disclosed in commonly owned U.S. patent application Ser. No. 08/109,832, filed Aug. 20, 1993 and entitled "Mounting Apparatus For A Modular Sofa Assembly", and U.S. patent application Ser. No. 08/209,159, filed Mar. 10, 1994 and entitled "Mounting Apparatus For Securing Independent Sections Of A Sectional Sofa Assembly" are both likewise applications.

The foregoing discussion discloses and describes exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A reclining chair comprising:

a pair of upholstered side frame members;

an actuation mechanism suspended from said side frame members;

cross rails interconnecting said side frame members to define a rigid chair frame within which said actuation mechanism is operably supported;

track means secured to a base assembly;

a seat assembly having a seat member and a seat back;

swing link means pivotally supporting said seat back and said seat member from said side frame members for causing said seat assembly to move between a non-reclined position and a fully reclined position in response to pressure applied by a seat occupant to said seat back;

a left bearing link assembly and a right bearing link assembly, each of said bearing link assemblies secured to said side frame members and having spaced wheel means which are respectively disposed for translational rolling movement within said track means, said track means being curved for causing an angular tilting movement of said chair frame relative to said base assembly upon translational movement of said bearing link assemblies within said track means;

a leg rest assembly supported from said actuation mechanism for movement between a retracted position and an extended position;

manually operated means associated with said actuation mechanism for selectively moving said leg rest assembly between said retracted and extended positions;

tilt linkage means for tilting said chair frame relative to said base assembly in response to movement of said leg rest assembly; and push linkage means connected between said base assembly and said seat member and adapted to coact with said swing link means for causing translational movement of said chair frame in response to reclining movement of said seat assembly, whereby said seat assembly can be moved through a range of reclined positions independently of actuation of said leg rest assembly, said push linkage means including stop means for defining a forward and a rearward limit of movement for said seat assembly between said fully reclined and non-reclined positions.

2. The reclining chair of claim 1 wherein said angular tilting movement of said chair frame due to reclining movement of said seat assembly is independent of and cumulative with said tilting movement of said chair frame due to movement of said leg rest assembly.

3. The reclining chair of claim 2 wherein said track means define left and right channel-like tracks and which are curved forwardly from back to front, said bearing link assemblies having pivot means interconnected to said tilt linkage means for tilting said chair frame upon selective actuation of said manually operated means.

4. The reclining chair of claim 3 wherein said actuation mechanism comprises a transverse rotatable drive rod with said manually operated means being operable for selectively rotating said drive rod, and wherein said leg rest assembly and said tilt linkage means are operably connected to said drive rod such that upon said leg rest assembly moving from said retracted position toward said extended position said tilt linkage means drives said pivot means for tilting said chair frame.

5. The reclining chair of claim 4 wherein said tilt linkage means includes a left tilt linkage assembly operably coupled to said left bearing link assembly and a right tilt linkage assembly operably coupled to said right bearing link assembly, each of said left and right tilt linkage assemblies having a connector link mounted for rotation on said drive rod and a toggle link pivotally connected about a first pivot to one end of said connector link, said toggle link being pivotally connected about a second pivot at its opposite end to a pivot lever, said pivot lever having a first rear wheeled unit disposed in said track means, each of said bearing link assemblies also including a bearing link member pivotably connected to said pivot lever and having a second forward wheeled unit disposed in said track means, and wherein said bearing link member is fixed to bracket means for directly affixing said bearing link member to said side frame member of said chair frame for supporting said chair frame and said seat assembly thereon.

6. The reclining chair of claim 4 wherein said leg rest assembly includes pantograph linkage means operatively connected to said drive rod such that rotation of said drive rod moves said leg rest assembly and movement of said leg rest assembly rotates said drive rod, and wherein said reclining chair further includes an over-center linkage mechanism operatively connected between said drive rod and a support shaft, said over-center linkage mechanism adapted for retaining said leg rest assembly in said retracted position when said manually operated means is rotated in a first direction and for forwardly driving said leg rest assembly toward said extended position upon said manually operated means being rotated in a second opposite direction.

7. The reclining chair of claim 1 wherein said push linkage means comprises:

a first member fixed to said base assembly and wherein said stop means includes a stop projection formed on said first member; and a linkage operably connected between said first member and said seat member, said linkage being engageable with said stop projection on said first member upon movement of said seat assembly to said non-reclined position for defining said rearward limit of movement of said seat assembly relative to said chair frame.

8. The reclining chair of claim 7 wherein said first member is a bracket fixed to said base assembly, and said linkage comprises:

a first link pivotably coupled to said bracket;

a second link pivotably coupled to said first link; and a third link pivotably coupled between said second link and said seat assembly.

9. The reclining chair of claim 8 wherein said stop projection is formed on said bracket in proximity to said first link, whereby movement of said seat assembly to said non-reclined position causes said first link to engage said stop projection for inhibiting continued movement thereof.

10. The reclining chair of claim 8 wherein said stop means further comprises a second stop projection formed on said second link that is adapted to engage said third link upon movement of said seat assembly to said fully reclined position for inhibiting continued movement thereof and to define said forward limit of movement of said seat assembly relative to said chair frame.

11. A reclining chair comprising:

a chair frame;

an actuation mechanism suspended from said chair frame;

a seat assembly having a seat member and a seat back;

swing link means pivotally supporting said seat back and said seat member from said chair frame for causing said seat assembly to move between a non-reclined position and a fully reclined position in response to pressure applied by a seat occupant to said seat back;

a leg rest assembly supported from said actuation mechanism for movement between a retracted position and an extended position;

manually operated means associated with said actuation mechanism for selectively moving said leg rest assembly between said retracted and extended positions;

tilt linkage means for causing a tilting movement of said chair frame relative to said base assembly in response to movement of said leg rest assembly; and push linkage means connected between said base assembly and said seat member and adapted to coact with said swing link means for causing translational movement of said chair frame in response to reclining movement of said seat assembly, whereby said seat assembly can be moved through a range of reclined positions independently of actuation of said leg rest assembly, said push linkage means including stop means for defining a forward and a rearward limit of movement for said seat assembly between said fully reclined and non-reclined positions.

12. The reclining chair of claim 11 wherein said push linkage means comprises:

a first member fixed to said base assembly and wherein said stop means includes a stop projection formed on said first member; and a linkage operably connected between said first member and said seat member, said linkage being engageable with said stop projection on said first member upon movement of said seat assembly to said non-reclined position for defining said rearward limit of movement of said seat assembly relative to said chair frame.

13. The reclining chair of claim 12 wherein said first member is a bracket fixed to said base assembly, and said linkage comprises:

a first link pivotably coupled to said bracket;

a second link pivotably coupled to said first link; and a third pivotably coupled between said second link and said seat assembly.

14. The reclining chair of claim 13 wherein said stop projection is formed on said bracket in proximity to said first link, whereby movement of said seat assembly to said non-reclined position causes said first link to engage said stop projection for inhibiting continued movement thereof.

15. The reclining chair of claim 13 wherein said stop means further comprises a second stop projection formed on said second link that is adapted to engage said third link upon movement of said seat assembly to said fully reclined position for inhibiting continued movement thereof and to define said forward limit of movement of said seat assembly relative to said chair frame.

16. The reclining chair of claim 11 further comprising a left bearing link assembly and a right bearing link assembly, each of said bearing link assemblies secured to said chair frame and having spaced wheel means which are respectively disposed for translational rolling movement within track means secured to a base assembly, said track means being curved for causing an angular tilting movement of said chair frame relative to said base assembly upon translational movement of each of said bearing link assemblies within said track means, each of said bearing link assemblies having pivot means interconnected to said tilt linkage means for tilting said chair frame upon selective actuation of said manually operated means.

17. The reclining chair of claim 16 wherein each of said left and right bearing link assemblies comprise mounting means secured to a side panel of said chair frame and having means for fastening said bearing link assembly to said chair frame such that said chair frame is supported by said bearing link assembly from underneath.

18. The reclining chair of claim 17 wherein each of said left and right bearing link assemblies further comprise:

a pivot lever interconnected to said tilt linkage means at a first end and a rear wheeled unit disposed in said track means at a second end;

a bearing link member pivotably connected to said pivot lever between said first and second ends of said pivot lever, said bearing link member having a forward wheeled unit disposed in said track means at a first end and an inwardly extending flange at a second end;

a flange bracket including a downwardly extending flange secured to said bearing link member and an outwardly extending flange;

said mounting means including a lower mounting bracket having an upwardly extending flange secured to said side panel and an outwardly extending flange secured to said outwardly extending flange of said flange bracket, said outwardly extending flange having a threaded aperture for receiving a threaded fastener to affix said chair frame to said bearing link assembly; and an upper mounting bracket including an upwardly extending flange secured to said side panel and an inwardly extending flange secured to said inwardly extending flange of said bearing link member.

19. The reclining chair of claim 16 wherein said angular tilting movement of said chair frame due to reclining movement of said seat assembly is independent of and cumulative with said tilting movement of said chair frame due to movement of said leg rest assembly.

20. The reclining chair of claim 19 wherein said actuation mechanism comprises a transverse rotatable drive rod with said manually operated means being operable for selectively rotating said drive rod, and wherein said leg rest assembly and said tilt linkage means are operably connected to said drive rod such that upon said leg rest assembly moving from said retracted position toward said extended position said tilt linkage means drives said pivot means for tilting said chair frame.

21. The reclining chair of claim 20 wherein said tilt linkage means includes a left tilt linkage assembly operably coupled to said left bearing link assembly and a right tilt linkage assembly operably coupled to said right bearing link assembly, each of said left and right tilt linkage assemblies having a connector link mounted for rotation on said drive rod and a toggle link pivotally connected about a first pivot to one end of said connector link, said toggle link being pivotally connected about a second pivot at its opposite end to a pivot lever, said pivot lever having a first rear wheeled unit disposed in said track means, each of said bearing link assemblies also including a bearing link member pivotably connected to said pivot lever and having a second forward wheeled unit disposed in said track means, and wherein said bearing link member is fixed to bracket means for directly affixing said bearing link member to said chair frame for supporting said chair frame and said seat assembly thereon.

22. The reclining chair of claim 20 wherein said leg rest assembly includes a pantograph linkage means operatively connected to said drive rod such that rotation of said drive rod moves said leg rest assembly and movement of said leg rest assembly rotates said drive rod, and wherein said reclining chair further includes an over-center linkage mechanism operatively connected between said drive rod and a support shaft, said over-center linkage mechanism adapted for retaining said leg rest assembly in said retracted position when said manually operated means is rotated in a first direction and for forwardly driving said leg rest assembly toward said extended position upon said manually operated means being rotated in a second opposite direction.

23. A reclining chair comprising:

a chair frame;

an actuation mechanism suspended from said chair frame;

a seat assembly having a seat member and a seat back;

swing link means pivotally supporting said seat back and seat member from said chair frame for causing said seat assembly to move between a non-reclined position and a fully reclined position in response to pressure applied by a seat occupant to said seat back;

a leg rest assembly supported from said actuation mechanism for movement between a retracted position and an extended position;

manually operated means associated with said actuation mechanism for selectively moving said leg rest assembly between said retracted and extended positions; and push linkage means connected between a base assembly and said seat member and adapted to coact with said swing link means for causing translational movement of said chair frame in response to reclining movement of said seat assembly, whereby said seat assembly can be moved through a range of reclined positions independently of actuation of said leg rest assembly, said push linkage means including stop means for defining a forward and a rearward limit of movement for said seat assembly between said fully reclined and non-reclined positions.

24. The reclining chair of claim 23 wherein said push linkage means comprises:

a first member fixed to said base assembly and wherein said stop means includes a stop projection formed on said first member; and a linkage operably connected between said first member and said seat member, said linkage being engageable with said stop projection on said first member upon movement of said seat assembly to said non-reclined position for defining said rearward limit of movement of said seat assembly relative to said chair frame.

25. The reclining chair of claim 24 wherein said first member is a bracket fixed to said base assembly, and said linkage comprises:

a first link pivotably coupled to said bracket;

a second link pivotably coupled to said first link; and a third link pivotably coupled between said second link and said seat assembly.

26. The reclining chair of claim 25 wherein said stop projection is formed on said bracket in proximity to said first link, whereby movement of said seat assembly to said non-reclined position causes said first link to engage said stop projection for inhibiting continued movement thereof.

27. The reclining chair of claim 25 wherein said stop means further comprises a second stop projection formed on said second link that is adapted to engage said third link upon movement of said seat assembly to said fully reclined position for inhibiting continued movement thereof and to define said forward limit of movement of said seat assembly relative to said chair frame.

28. The reclining chair of claim 23 further comprising a left bearing link assembly and a right bearing link assembly, each of said bearing link assemblies secured to said chair frame and having spaced wheel means which are respectively disposed for translational rolling movement within track means, said track means secured to a base assembly and curved for causing an angular tilting movement of said chair frame relative to said base assembly upon translational movement of each of said bearing link assemblies within said track means, each of said bearing link assemblies having pivot means interconnected to tilt linkage means for tilting said chair frame upon selective actuation of said manually operated means.

29. The reclining chair of claim 28 wherein each of said left and right bearing link assemblies comprise mounting means secured to a side panel of said chair frame and having means for fastening said bearing link assembly to said chair frame such that said chair frame is supported by said bearing link assembly from underneath.

30. The reclining chair of claim 29 wherein each of said left and right bearing link assemblies further comprise:

a pivot lever interconnected to said tilt linkage means at a first end and a rear wheeled unit disposed in said track means at a second end;

a bearing link member pivotably connected to said pivot lever between said first and second ends of said pivot lever, said bearing link member having a forward wheeled unit disposed in said track means at a first end and an inwardly extending flange at a second end;

a flange bracket including a downwardly extending flange secured to said bearing link member and an outwardly extending flange;

said mounting means including a lower mounting bracket having an upwardly extending flange secured to said side panel and an outwardly extending flange secured to said outwardly extending flange of said flange bracket, said outwardly extending flange having a threaded aperture for receiving a threaded fastener to affix said chair frame to said bearing link assembly; and an upper mounting bracket including an upwardly extending flange secured to said side panel and an inwardly extending flange secured to said inwardly extending flange of said bearing link member.

31. The reclining chair of claim 28 wherein said tilt linkage means further comprises means for tilting said chair frame relative to said base assembly in response to movement of said leg rest assembly.

32. The reclining chair of claim 31 wherein said angular tilting movement of said chair frame due to reclining movement of said seat assembly is independent of and cumulative with said tilting movement of said chair frame due to movement of said leg rest assembly.

33. The reclining chair of claim 31 wherein said actuation mechanism comprises a transverse rotatable drive rod with said manually operated means being operable for selectively rotating said drive rod, and wherein said leg rest assembly and said tilt linkage means are operably connected to said drive rod such that upon said leg rest assembly moving from said retracted position toward said extended position said tilt linkage means drives said pivot means for tilting said chair frame.

34. The reclining chair of claim 33 wherein said tilt linkage means includes a left tilt linkage assembly operably coupled to said left bearing link assembly and a right tilt linkage assembly operably coupled to said right bearing link assembly, each of said left and right tilt linkage assemblies having a connector link mounted for rotation on said drive rod and a toggle link pivotally connected about a first pivot to one end of said connector link, said toggle link being pivotally connected about a second pivot at its opposite end to a pivot lever, said pivot lever having a first rear wheeled unit disposed in said track means, each of said bearing link assemblies also including a bearing link member pivotably connected to said pivot lever and having a second forward wheeled unit disposed in said track means, and wherein said bearing link member is fixed to bracket means for directly affixing said bearing link member to a side frame member of said chair frame for supporting said chair frame and said seat assembly thereon.

35. The reclining chair of claim 33 wherein said leg rest assembly includes pantograph linkage means operatively connected to said drive rod such that rotation of said drive rod moves said leg rest assembly and movement of said leg rest assembly rotates said drive rod, and wherein said reclining chair further includes an over-center linkage mechanism operatively connected between said drive rod and a support shaft, said over-center linkage mechanism adapted for retaining said leg rest assembly in said retracted position when said manually operated means is rotated in a first direction and for forwardly driving said leg rest assembly toward said extended position upon said manually operated means being rotated in a second opposite direction.

* * * * *

UNITED STATES PATENT AND TRADEMARK OFFICE

CERTIFICATE OF CORRECTION

PATENT NO. : 5,570,927

DATED : November 5, 1996

INVENTOR(S) : Larry P. LaPointe, et al.

It is certified that error appears in the above-indentified patent and that said Letters Patent is hereby corrected as shown below:

Column 1, line 13, after "5,427,431" insert -- ) --.

Column 4, line 31,
"an enlarged" should be -- a plan --.

Column 4, line 32,
"." (second occurrence in patent) should be -- ; --.

Column 4, line 42,
delete "as".

Column 10, line 48,
"link s" should be -- links --.

Column 15, line 53,
"21 6" should be -- 216 --.

UNITED STATES PATENT AND TRADEMARK OFFICE

CERTIFICATE OF CORRECTION

PATENT NO. : 5,570,927

DATED : November 5, 1996

INVENTOR(S) : Larry P. LaPointe, et al.

It is certified that error appears in the above-indentified patent and that said Letters Patent is hereby corrected as shown below:

Column 23, line 27, claim 13,
after "third" insert -- link --.

Signed and Sealed this

Tenth Day of June, 1997

Bruce Lehman

*Attest:*

BRUCE LEHMAN

*Attesting Officer*

*Commissioner of Patents and Trademarks*